US008702215B2

(12) United States Patent
Kawase et al.

(10) Patent No.: US 8,702,215 B2
(45) Date of Patent: Apr. 22, 2014

(54) INKJET HEAD UNIT AND INKJET APPARATUS

(75) Inventors: Junya Kawase, Yokohama (JP); Yasuyuki Tamura, Yokohama (JP); Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/612,497

(22) Filed: Sep. 12, 2012

(65) Prior Publication Data

US 2013/0106963 A1 May 2, 2013

(30) Foreign Application Priority Data

Nov. 1, 2011 (JP) ..... 2011-240298

(51) Int. Cl.
*B41J 2/18* (2006.01)
*B41J 2/175* (2006.01)

(52) U.S. Cl.
USPC ..... 347/89; 347/85

(58) Field of Classification Search
USPC ..... 347/7, 84–85, 89, 93
See application file for complete search history.

(56) References Cited

U.S. PATENT DOCUMENTS

| | | | | | |
|---|---|---|---|---|---|
| 5,159,348 | A * | 10/1992 | Dietl et al. | ..... | 347/89 |
| 5,561,448 | A * | 10/1996 | Kaneko et al. | ..... | 347/29 |
| 6,231,174 | B1 * | 5/2001 | Haigo | ..... | 347/89 |
| 6,742,882 | B2 * | 6/2004 | Nakamura | ..... | 347/89 |
| 7,597,434 | B2 * | 10/2009 | Nitta et al. | ..... | 347/89 |
| 8,235,495 | B2 * | 8/2012 | Okada | ..... | 347/17 |
| 8,256,855 | B2 * | 9/2012 | Yamada | ..... | 347/7 |

FOREIGN PATENT DOCUMENTS

| | | | |
|---|---|---|---|
| JP | 2000-507522 | A | 6/2000 |
| JP | 2011-046109 | A | 3/2011 |
| JP | 2011-062858 | A | 3/2011 |
| JP | 2011-110853 | A | 6/2011 |

* cited by examiner

*Primary Examiner* — Anh T. N. Vo
(74) *Attorney, Agent, or Firm* — Canon USA Inc IP Division

(57) ABSTRACT

There is provided an inkjet apparatus capable of adjusting pressure in an inkjet head to a predetermined slightly negative pressure without limitations on the installation location of a pressure adjustment unit and without stopping the flow of liquid. The inkjet apparatus includes an inkjet head for discharging ink droplets and an ink tank for retaining liquid to the inkjet head. The inkjet apparatus further includes a liquid feeding unit communicating with the inkjet head and configured to feed the liquid in the ink tank to the inkjet head by reducing the pressure in the inkjet head, an open-close valve configured to open or close a flow channel connecting the inkjet head and the liquid feeding unit, and a pressure adjustment unit configured to open or close the open-close valve according to a pressure difference between inside and outside of the flow channel to adjust the pressure in the inkjet head.

19 Claims, 12 Drawing Sheets

INKJET HEAD UNIT AND INKJET APPARATUS

BACKGROUND OF THE INVENTION

1. Field of the Invention

The present disclosure relates to an inkjet head unit and an inkjet apparatus. Especially, the inkjet head unit can be replaced with a new one as a unit to the inkjet apparatus.

2. Description of the Related Art

Inkjet apparatuses each having an inkjet head for discharging ink on a medium are known. The medium is a material onto which the discharged ink impacts. The inkjet apparatuses have been increasingly used in many industries. In the present invention, the media includes all media used in those industries as the materials onto which ink is to be discharged. To facilitate understanding, in the descriptions below, a recording medium such as recording paper is described as an example.

An inkjet apparatus described as an example has a carriage that reciprocates over a recording medium. On the carriage, an inkjet head is mounted. The inkjet head has a discharge pressure generation element for generating a pressure for discharging ink, and a discharge nozzle. The discharge pressure generation element operates in conjunction with the reciprocating operation of the carriage, and the discharge nozzle discharges ink droplets.

The recording medium is intermittently conveyed in conjunction with the carriage operation. The reciprocating operation of the carriage and the conveyance of the recording medium are alternately performed to form characters and images on the recording medium.

The inkjet apparatus includes an ink supply container (hereinafter, referred to as an ink tank). The ink tank can be expressed as an ink retaining unit in terms of a function of retaining the ink. The attached ink tank is connected to the inkjet head via a liquid conducting tube formed in a hollow shape using a flexible material. The ink retained in the ink tank passes through the liquid conducting tube, and is supplied to the inkjet head.

In such an inkjet apparatus, the amount of the ink droplets and the discharge direction can be stabilized by forming a meniscus with a good ink condition in the discharge nozzle at the opening of the discharge nozzle of the inkjet head. The stable ink discharge stabilizes the quality of the image formed on the recording medium. The formation of the meniscus with the good ink condition in the discharge nozzle can be implemented, for example, by maintaining the inside of the inkjet head in a slightly negative pressure state.

When the discharge of the ink is continued, the condition of the ink can be changed to the following conditions. For example, in the discharge nozzle, the solvent in the ink vapors in the air and thereby the viscosity of the ink increases, bubbles accumulate in an ink chamber near the discharge pressure generation element or in an ink chamber to which the discharge pressure generation element is provided, or dusts exist near the ink chamber or the discharge nozzle.

In such conditions, it is known that the inkjet head causes decrease in the quality of a recorded image. In other words, under such conditions, the direction of the ink droplets discharged from the discharge nozzle can deviate from the expected discharge direction.

Due to the deviation of the discharge direction, the impact positions of the ink droplets on the recording medium deviate from expected positions. As a result, the quality of the recorded image decreases. If the above conditions of the discharge nozzle proceed and become worse, the ink droplets may not be discharged from the discharge nozzle. In the specification, for convenience, such a condition is expressed as clogging of the discharge nozzle.

The Japanese Unexamined Patent Application Publication (Translation of PCT Application) No. 2000-507522 discusses a structure for circulating ink between an ink tank and an inkjet head while the inside of the inkjet head is maintained in a slightly negative pressure state. The circulation of the ink provides an environment in which the above-mentioned undesirable conditions in the discharge nozzle can be reduced, and thereby the decrease in the quality of the recorded image can be reduced.

An inkjet apparatus discussed in Japanese Unexamined Patent Application Publication (Translation of PCT Application) No. 2000-507522 includes a pressure pump for applying pressure to ink in an ink tank and feeding the ink to an inkjet head, and a pressure adjustment unit provided in the middle of the channel from the inkjet head to the ink tank.

The pressure adjustment unit maintains the inside of the inkjet head in a slightly negative pressure state using a water head difference between the ink liquid level of a discharge nozzle in the inkjet head and the ink liquid level in the pressure adjustment unit. In other words, the inkjet apparatus performs the ink circulation and the ink pressure adjustment using the pressure pump and the water head difference type pressure adjustment unit.

However, in the water head difference type pressure adjustment unit, the pressure in the inkjet head cannot be maintained in a predetermined slightly negative pressure state if the ink tank is not disposed at a position lower than the discharge surface (the plane the discharge nozzle is formed) of the inkjet head in the direction of gravitational force. Consequently, in the inkjet apparatus discussed in Japanese Unexamined Patent Application Publication (Translation of PCT Application) No. 2000-507522, the installation location of the pressure adjustment unit is limited to a position lower than the inkjet head in the direction of gravitational force.

Further, in the head difference type pressure adjustment unit, the pressure in the inkjet head is determined depending on the distance between the discharge surface of the inkjet head and the pressure adjustment unit in the direction of gravitational force. Consequently, if the pressure in the inkjet head is to be maintained at a low negative pressure, the pressure adjustment unit is to be disposed at a further lower position in the direction of gravitational force. As a result, due to the limitation in the required size of the inkjet apparatus, and the like, the installation location of the pressure adjustment unit is further limited.

To solve the problems, the inventors tried to reduce the pressure of the ink in the inkjet head using a decompression pump.

However, when the decompressing pump is directly connected to the inkjet head, there is a possibility that the pressure of the ink in the inkjet head would decrease too low depending on the output of the decompression pump. If the pressure decreases too low, the meniscus formed at the discharge nozzle is pulled too much, and this makes the amount of the ink droplets to be discharged from the inkjet head unstable. As a result, the quality of the recorded image decreases.

Especially, a good meniscus in the discharge nozzle is formed at a slightly negative pressure less than atmospheric pressure by about 0.6 kPa. Unfortunately, at present, it is very difficult to stably adjust the pressure to the slightly negative pressure by controlling the output of the decompression pump.

SUMMARY OF THE INVENTION

The present disclosure is directed to an inkjet head unit and an inkjet apparatus having a structure capable of readily adjusting the pressure in the inkjet head to a predetermined slightly negative pressure without limitations on the installation location of a pressure adjustment unit and without stopping the flow of liquid.

The present disclosure is proposed to achieve the above objects, and an idea of disposing an operation mechanism provided with an open-close mechanism such as a pressure response valve that is opened or closed depending on a difference in pressure at a position downstream of an inkjet head is conceived.

According to an aspect disclosed herein, an inkjet head unit is provided. The inkjet head unit includes an inkjet head, and an operation mechanism disposed downstream of the inkjet head with respect to an ink flow direction. The inkjet head unit is attached between an ink retaining unit and a negative pressure source in an inkjet recording apparatus having the ink retaining unit configured to retain the ink to be supplied to the inkjet head and the negative pressure source configured to apply negative pressure to the inkjet head to supply the ink from the ink retaining unit to the inkjet head, and while the ink discharge operation from the inkjet head is being performed, the operation of the operation mechanism maintains the negative pressure state of the inkjet head, and adjusts the flow of the ink.

According to another aspect of the present disclosure, an inkjet head unit is provided. The inkjet head unit includes an inkjet head configured to discharge ink droplets, the inkjet head is attached or detached to/from an inkjet apparatus having an ink tank configured to retain liquid to be supplied to the inkjet head, and a liquid feeding unit configured to communicate with the inkjet head and feed the liquid in the ink tank to the inkjet head by reducing the pressure in the inkjet head, an open-close valve configured to open or close a flow channel connecting the inkjet head and the liquid feeding unit, and a pressure adjustment unit configured to open or close the open-close valve depending on a pressure difference between inside and outside of the flow channel to adjust the pressure in the inkjet head.

According to yet another aspect disclosed herein, an inkjet recording apparatus is provided. The inkjet recording apparatus includes an ink tank, an inkjet head, and a negative pressure source. The ink tank, the inkjet head, and the negative pressure source are connected by ink flow channels in this order, and the pressure of the inkjet head is adjusted by a layout of the ink tank and the inkjet head in the height direction and negative pressure generated by the negative pressure source, an operation mechanism configured to operate depending on a difference between the pressure in the flow channel at the inkjet head side and the pressure in the ink flow channel at the negative pressure source side is provided on the ink flow channel between the inkjet head and the negative pressure source, and while the ink discharge operation from the inkjet head is being performed, the flow of the ink from the ink tank through the inkjet head to the negative pressure source is adjusted such that the pressure of the inkjet head is maintained in a state suitable for the ink discharge through cooperation between the operation mechanism and the negative pressure source.

According to yet another aspect of the present disclosure, an inkjet head unit is provided. The inkjet head unit includes an inkjet head configured to discharge ink droplets, an ink tank configured to retain liquid to be supplied to the inkjet head, a liquid feeding unit communicating with the inkjet head, the unit configured to feed the liquid in the ink tank to the inkjet head by reducing the pressure in the inkjet head, and a pressure adjustment unit having an open-close valve configured to open or close the flow channel connecting the inkjet head and the liquid feeding unit, the pressure adjustment unit opens or closes the open-close valve depending on a pressure difference in the upstream and downstream of the open-close valve to adjust the pressure in the inkjet head.

According to the exemplary embodiments of the present disclosure, the operation mechanism that functions as the pressure adjustment unit can be disposed without limitations on its installation location, and the pressure in the inkjet head can be adjusted to a predetermined slightly negative pressure without stopping the flow of liquid.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects disclosed herein and, together with the description, serve to explain the principles of the disclosure.

DESCRIPTION OF THE EMBODIMENTS

Various exemplary embodiments, features, and aspects of the disclosure will be described in detail below with reference to the drawings.

Figure 1:
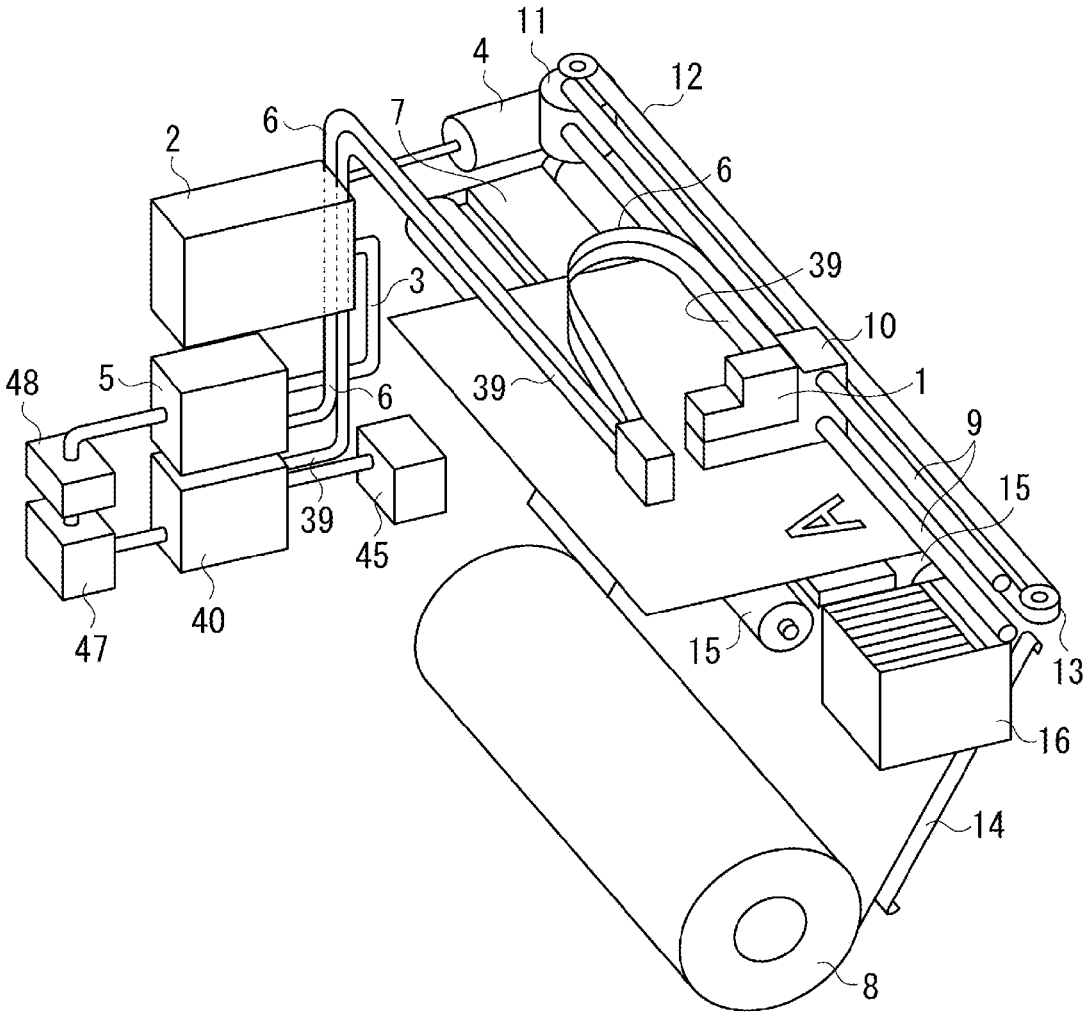
FIG. 1 is a perspective view schematically illustrating an inkjet apparatus according to a first exemplary embodiment.

FIG. 1 is a perspective view schematically illustrating an inkjet apparatus according to a first exemplary embodiment. As illustrated in FIG. 1, the inkjet apparatus includes an inkjet head unit 1 (hereinafter, simply referred to as head unit 1), and an ink tank 2 that retains liquid (ink) to be supplied to the head unit 1. The head unit 1 is connected to the head unit 1 via a conducting tube such as a first liquid conducting tube 3.

The ink tank 2 is replaceable to the inkjet apparatus. The ink in the ink tank 2 is pushed out from the ink tank 2 by a pressure pump 4, and supplied to the head unit 1 via the first liquid conducting tube 3, a first sub-tank 5, and further a second liquid conducting tube 6.

The ink supplied to the head unit 1 is discharged toward a recording medium 8 that is conveyed on a platen 7 under the control of a control substrate (not illustrated) provided in the inkjet apparatus.

The head unit 1 is mounted on a carriage 10 that can reciprocate along slide shafts 9. The carriage 10 is moved along the slide shafts 9 using a carriage motor 11, a carriage belt 12, and a pulley 13. In conjunction with the movement of the carriage 10, the head unit 1 mounted on the carriage 10 reciprocates over the platen 7.

Under the platen 7, the recording medium 8 that is wound in a rolled state is rotatably supported. The recording medium 8 is conveyed onto the platen 7 using a guide 14 and a line feed (LF) roller group 15.

The inkjet apparatus intermittently conveys the recording medium 8 onto the platen 7, and discharges the ink from the head unit 1 while reciprocating the head unit 1 over the platen 7. As a result, recording is sequentially performed onto the recording medium 8 on the platen 7. Such an inkjet apparatus that performs the recording by alternately reciprocating the carriage 10 and conveying the recording medium 8 is called a serial-type inkjet apparatus.

The inkjet apparatus further includes a recovery device 16 outside the range where the head unit 1 reciprocates in the recording operation. The recovery device 16 recovers discharge failure of the head unit 1.

Figure 2A:
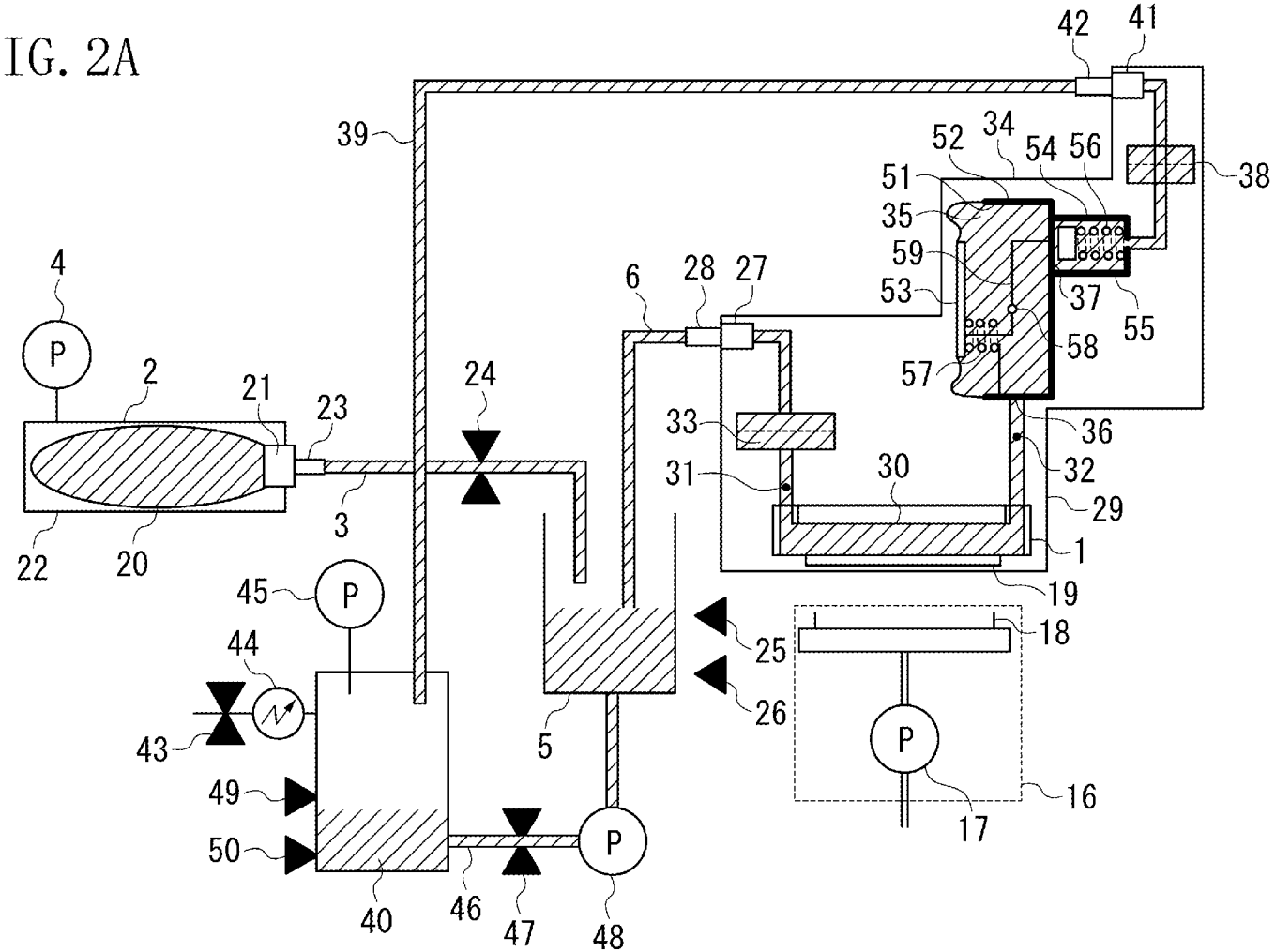
FIGS. 2A and 2B are schematic views illustrating a structure of an ink supply system of the inkjet apparatus and a structure of a recovery device illustrated in FIG. 1.
Figure 2B:
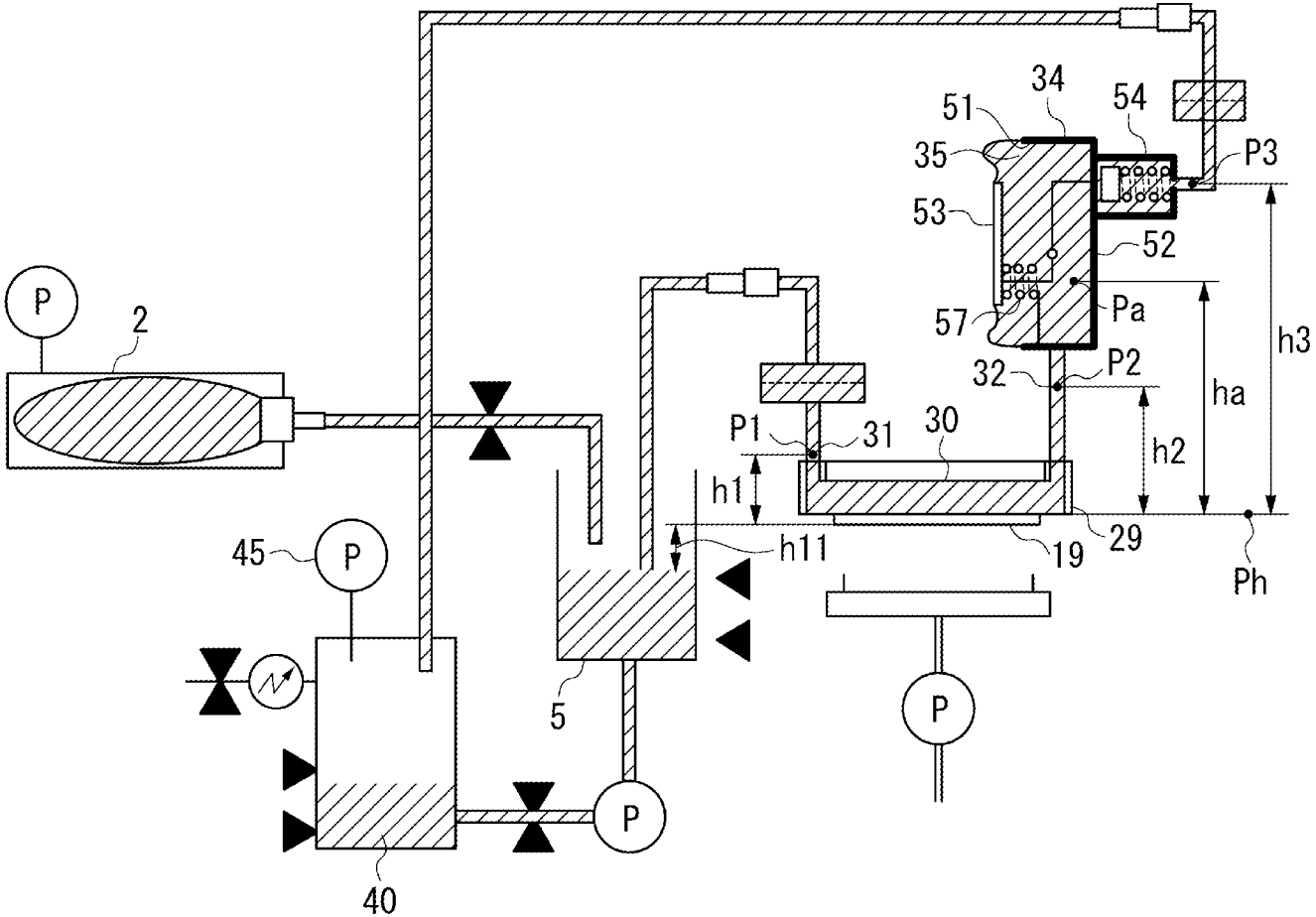

Referring to FIGS. 2A and 2B, structures of an ink supply system and the recovery device 16 in the inkjet apparatus are described. FIG. 2A is a schematic view illustrating a structure of the ink supply system and a structure of the recovery device 16 in the inkjet apparatus illustrated in FIG. 1.

The structure of the recovery device 16 is described.

As illustrated in FIG. 2A, the recovery device 16 includes a recovery pump 17 and a nozzle cap 18. To recover a discharge failure of the head unit 1, first, the head unit 1 is moved over the recovery device 16, and the nozzle cap 18 is pressed onto the head unit 1. After the operation, due to negative pressure generated by the recovery pump 17, the ink in a discharge nozzle 19 of the head unit 1 is suctioned and removed.

If the ink remaining in the discharge nozzle 19 is left, the viscosity of the ink in the discharge nozzle 19 increases, and this can cause a discharge failure in the discharge nozzle 19. The recovery device 16 can prevent the remaining of the ink in the discharge nozzle 19 and the discharge failure caused by the increased viscosity of the ink.

The structure of the ink supply system is described. The ink tank 2 includes a bag body 20, a first rubber stopper 21, and a case 22. The bag body 20 is formed of a flexible material. The first rubber stopper 21 seals the ink guide port of the bag body 20. The case 22 seals the bag body 20.

At one end of the first liquid conducting tube 3, a first ink needle 23 that is a hollow tube having a sharp tip is provided. The first ink needle 23 is inserted into the first rubber stopper 21, and thereby the first liquid conducting tube 3 communicates with the bag body 20.

To the case 22, the pressure pump 4 is connected. The pressure pump 4 sends pressure air into the case 22 to press the bag body 20, and thereby the ink stored in the bag body 20 is pushed out to the first liquid conducting tube 3.

To the first liquid conducting tube 3 that connects the ink tank 2 and the first sub-tank 5, a tank open-close valve 24 is provided. Driving of the pressure pump 4 in a state where the tank open-close valve 24 is opened supplies the ink from the ink tank 2 to the first sub-tank 5.

The first sub-tank 5 is always open to the atmosphere. The first sub-tank 5 includes a first liquid level sensor 25 and a second liquid level sensor 26. The first liquid level sensor 25 detects whether the first sub-tank 5 is filled with the ink. The second liquid level sensor 26 detects whether the first sub-tank 5 is empty.

The first liquid level sensor 25 and the second liquid level sensor 26 detect the liquid level of the ink in the first sub-tank 5, and thereby detect whether the first sub-tank 5 is filled with the ink or empty.

When the first liquid level sensor 25 detects decrease of the liquid level of the ink in the first sub-tank 5, the tank open-close valve 24 is opened, and the pressure pump 4 is driven. As a result, the bag body 20 is pressed and the ink in the bag body 20 is supplied to the first sub-tank 5.

When the ink is supplied and the liquid level of the ink in the first sub-tank 5 is detected by the first liquid level sensor 25, the tank open-close valve 24 is closed, and the ink supply operation to the first sub-tank 5 ends.

The first sub-tank 5 is connected to the head unit 1 using the second liquid conducting tube 6. At a flow inlet for ink in the head unit 1, a second rubber stopper 27 is provided. At one end of the second liquid conducting tube 6, a second ink needle 28 is provided. The second ink needle 28 is inserted into the second rubber stopper 27, and the second liquid conducting tube 6 and the head unit 1 are connected.

The head unit 1 includes an inkjet head 29 that discharges ink droplets. To the inkjet head 29, the discharge nozzle 19 for discharging ink droplets downward in the direction of gravitational force and a common liquid chamber 30 for supplying the ink to the discharge nozzle 19 are formed.

To the inkjet head 29, a head flow inlet 31 and a head flow outlet 32 are also formed. The head flow inlet 31 guides the ink into the common liquid chamber 30. The head flow outlet 32 lets the ink out from the common liquid chamber 30.

An ink flow-in channel is formed from the flow inlet of the head unit 1 at which the second rubber stopper 27 is provided to the head flow inlet 31. The ink supplied to the head unit 1 passes through the flow-in channel, and the ink is sent to the inkjet head 29. To the flow-in channel, a first filter 33 is provided.

The head unit 1 further includes a pressure adjustment unit 34 that adjusts the pressure in the inkjet head 29 to a predetermined slightly negative pressure and sends the ink in the first sub-tank 5 to the common liquid chamber 30.

To the pressure adjustment unit 34, a liquid storage chamber 35, a storage chamber flow inlet 36, and a storage chamber flow outlet 37 are formed. The liquid storage chamber 35 stores the ink and increases or decreases the pressure of the ink. The storage chamber inlet 36 guides the ink into the liquid storage chamber 35. The storage chamber flow outlet 37 flows the ink out from the liquid storage chamber 35.

The storage chamber flow inlet 36 is connected to the head flow outlet 32 via a flow channel. In other words, the pressure adjustment unit 34 is disposed at a downstream side of the inkjet head 29 with respect to the ink flow direction.

The storage chamber flow outlet 37 is connected to the ink flow outlet of the head unit 1 via an outflow channel. In the middle of the outflow channel, a second filter 38 is provided.

The ink flow outlet in the head unit 1 is connected to a second sub-tank 40 via a third liquid conducting tube 39. At the flow outlet in ink in the head unit 1, a third rubber stopper 41 is provided. At one end of the third liquid conducting tube 39, a third ink needle 42 is provided.

The third ink needle 42 is inserted into the third rubber stopper 41, and the ink flow outlet in the head unit 1 communicates with the third liquid conducting tube 39.

In the liquid storage chamber 35, sometimes gas (air) dissolved in the ink can be collected. To effectively discharge the gas (air) collected in the liquid storage chamber 35 to the second sub-tank 40, it is preferable to arrange the storage chamber flow outlet 37 on an upper side of the liquid storage chamber 35 in the direction of gravitational force.

The second sub-tank 40 includes an air open valve 43. When the air open vale 43 is closed, the inside of the second sub-tank 40 is sealed. The second sub-tank 40 includes a pressure sensor 44 for detecting pressure in the second sub-tank 40.

To the second sub-tank 40, a decompression pump 45 is connected. When the decompression pump 45 is driven in a state where the air open valve 43 is closed, the gas in the second sub-tank 40 is discharged to the outside, and the pressure in the second sub-tank 40 decreases.

In response to the decrease of the pressure in the second sub-tank 40, the ink in the inkjet head 29 is fed to the second sub-tank 40. The outflow of the ink in the inkjet head 29 reduces the pressure in the inkjet head 29, and thereby the ink in the first sub-tank 5 is fed to the inkjet head 29.

As described above, in the present exemplary embodiment, the sealed second sub-tank 40 and the decompression pump 45 function as a liquid feeding unit. The liquid feeding unit reduces the pressure in the inkjet head 29 to feed the ink stored in the first sub-tank 5 to the inkjet head 29.

The liquid feeding unit also functions as a negative pressure source of the inkjet recording apparatus, and consequently, the unit is also referred to as a negative pressure generation unit.

Preferably, the decompression pump 45 is a diaphragm pump, however, pumps of the other types can be employed.

The second sub-tank 40 is connected to the first sub-tank 5 via a fourth liquid conducting tube 46. The fourth liquid conducting tube 46 includes a flow channel open-close valve 47 and a liquid feeding pump 48. The flow channel open-close valve 47 opens or closes the fourth liquid conducting tube 46. The liquid feeding pump 48 feeds the ink from the second sub-tank 40 to the first sub-tank 5.

In the present exemplary embodiment, as the liquid feeding pump 48, a tube pump that continuously crush a flexible tube using a plurality of rollers to send the ink in the tube is employed.

The second sub-tank 40 includes a third liquid level sensor 49 and a fourth liquid level sensor 50. The third liquid level sensor 49 detects whether the second sub-tank 40 is filled with the ink. The fourth liquid level sensor 50 detects whether the second sub-tank 40 is empty.

When the third liquid level sensor 49 detects increase of the liquid level of the ink in the second sub-tank 40, the inkjet apparatus opens the flow channel open-close valve 47, and drives the liquid feeding pump 48 to feed the ink in the second sub-tank 40 to the first sub-tank 5.

When the first liquid level sensor 25 has already detected that the first sub-tank 5 is filled with the ink, the feeding of the ink from the second sub-tank 40 to the first sub-tank 5 is not performed.

When the fourth liquid level sensor 50 detects that the ink in the second sub-tank 40 is empty, the inkjet apparatus closes the flow channel open-close valve 47 and stops the drive of the liquid feeding pump 48.

When the first liquid level sensor 25 detects that the first sub-tank 5 has filled with the ink, also, the feeding of the ink from the second sub-tank 40 to the first sub-tank 5 is stopped.

The ink fed to the first sub-tank 5 is supplied to the inkjet head 29 again.

Figure 3A:
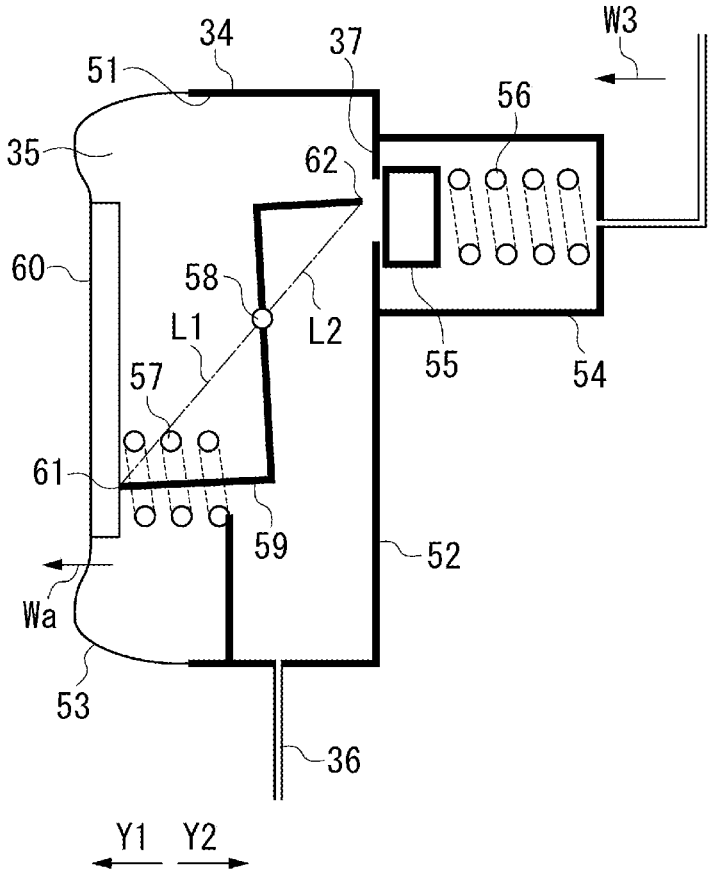
FIGS. 3A, 3B, and 3C are schematic views illustrating a structure and operation of a pressure adjustment unit.
Figure 3B:
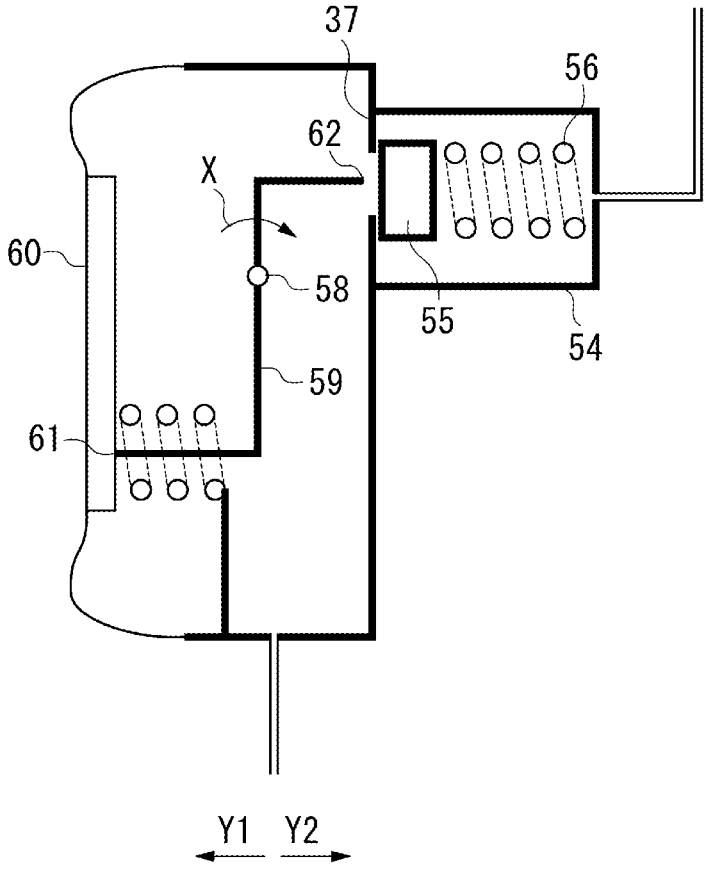
Figure 3C:
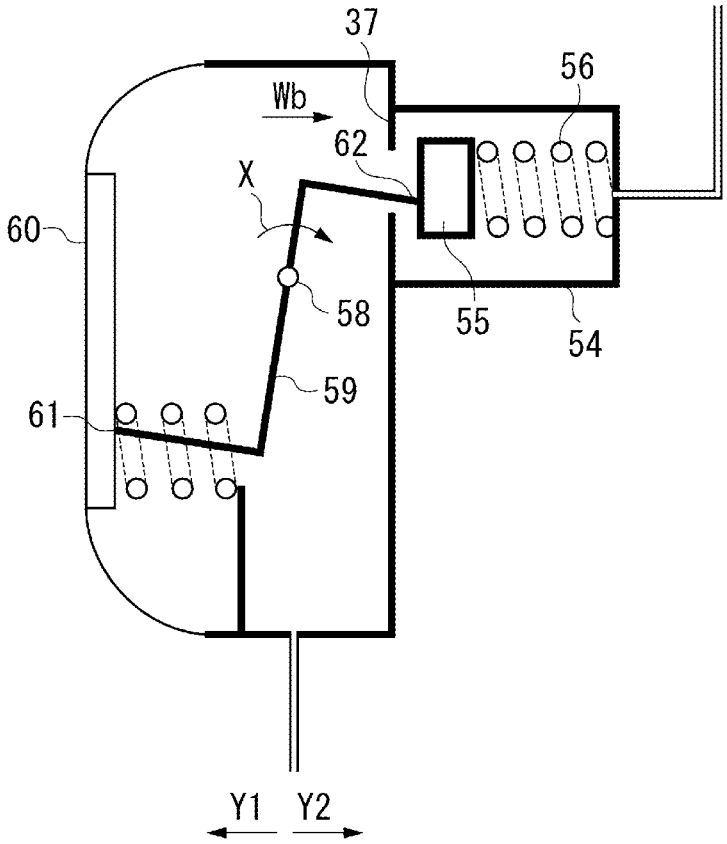

A structure and operation of the pressure adjustment unit 34 is described in detail with reference to FIGS. 3A to 3C. FIGS. 3A, 3B, and 3C are schematic views illustrating the structure and operation of the pressure adjustment unit 34.

As illustrated in FIG. 3A, the pressure adjustment unit 34 includes a storage chamber member 52 having a recessed portion 51 and a flexible member 53 for covering the opening of the recessed portion 51. In other words, the flexible member 53 is a part of a peripheral wall of the liquid storage chamber 35. In the present exemplary embodiment, the recessed portion 51 is formed in a cylindrical shape.

Preferably, the flexible member 53 is a resin film having flexibility and gas barrier properties, however, other materials having flexibility can be employed for the flexible member 53.

The storage chamber flow outlet 37 includes a storage chamber open-close valve 54 that opens or closes the storage chamber flow outlet 37. The storage chamber open-close valve 54 includes a valve element 55 that blocks the storage chamber flow outlet 37 from the outside of the liquid storage chamber 35. The valve element 55 has an open-close mechanism that is urged toward the peripheral edge of the storage chamber flow outlet 37 using a first spring 56.

The pressure adjustment unit 34 includes, in the liquid storage chamber 35, a second spring 57 and an arm 59. The second spring 57 presses the flexible member 53 in a direction (hereinafter, referred to as Y1 direction) the volume of the liquid storage chamber 35 is increased. The arm 59 can rotate about a rotation center 58. On a surface (hereinafter, referred to as internal surface) of the flexible member 53 at the side of the liquid storage chamber 35, a circular spring receiving plate 60 is bonded.

The spring receiving plate 60 is disposed on the flexible member 53 so that, when the spring receiving plate 60 is looked at from the Y1 direction, the center of the spring receiving plate 60 corresponds to the center of the cylindrically-shaped recessed portion 51. The diameter of the spring receiving plate 60 is shorter than the diameter of the cylindrical-shaped recessed portion 51. On the flexible member 53, a part on which the spring receiving plate 60 is not bonded exists.

On the flexible member 53, in the part the spring receiving plate 60 is not bonded, the flexibility is not lost. Consequently, with increase or decrease of the amount of ink in the liquid storage chamber 35, the part on the flexible member 53 deforms and the spring receiving plate 60 moves in the Y1 direction or in the opposite direction (hereinafter, referred to as Y2 direction) of the Y1 direction.

One end portion (hereinafter, referred to as first arm end portion 61) of the arm 59 is connected to the spring receiving plate 60. Consequently, with the movement of the spring receiving plate 60, that is, with the deformation of the flexible member 53, the arm 59 rotates about the rotation center 58.

As illustrated in FIG. 3B, when the spring receiving plate 60 moves in the Y1 direction, the arm 59 rotates in the X direction (clockwise direction in FIG. 3B) about the rotation center 58. As a result, the end portion (hereinafter, referred to as second arm end portion 62) at the opposite side of the first arm end portion 61 contacts the valve element 55.

The spring receiving plate 60 further moves in the Y1 direction from the state where the second arm end portion 62 contacts the valve element 55 and the arm 59 further rotates in the X direction, and as illustrated in FIG. 3C, the arm 59 moves the valve element 55 in the direction where the storage chamber flow outlet 37 is opened. When the storage chamber flow outlet 37 is open, the liquid storage chamber 35 communicates with the second sub-tank 40 (see FIGS. 2A and 2B).

When the spring receiving plate 60 moves in the Y2 direction from the state where the storage chamber flow outlet 37 is open, and the arm 59 rotates in the opposite direction of the X direction, as illustrated in FIG. 3A, the second arm end portion 62 moves away from the valve element 55. As a result, the first spring 56 presses the valve element 55 toward the storage chamber flow outlet 37, and the communication between the liquid storage chamber 35 and the second sub-tank 40 (see FIGS. 2A and 2B) is blocked.

As described above, the pressure adjustment unit 34 includes the combinations of the structural elements, and the pressure adjustment unit 34 serves as the operational mechanism that enables the adjustment of the pressure by the operation corresponding to the difference of the pressure. In terms of the functional aspect, the pressure adjustment unit 34 can be expressed as a pressure response valve or a valve mechanism.

An ink circulation operation in the inkjet apparatus according to the present exemplary embodiment is described with reference to FIGS. 2B, 3A, 3B, 3C, and FIG. 4.

Figure 4:
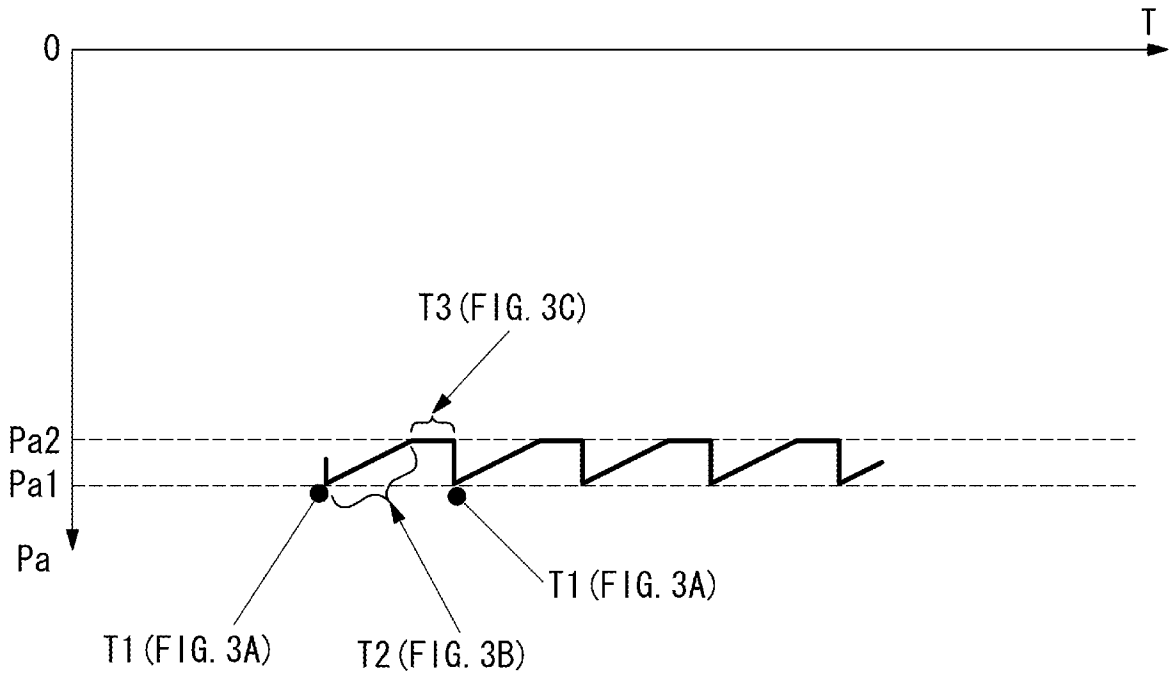
FIG. 4 is a graph illustrating time-sequential variation of the pressure of the ink in a liquid container during ink supply operation.

FIG. 2B illustrates, in addition to the schematic view of the ink supply system illustrated in FIG. 2A, individual distances (hereinafter, referred to as heights) in the direction of gravitational force of the head flow inlet 31, the head flow outlet 32, the storage chamber flow outlet 37, and the pressure adjustment unit 34 with respect to the discharge surface of the inkjet head 29. The height is defined as that the upper side is positive and the lower side is negative in the direction of gravitational force. FIG. 4 is a graph illustrating time-sequential variation of the pressure of the ink in the liquid storage chamber 35 during ink supply operation.

The discharge surface of the inkjet head 29 is the surface on which the discharge nozzle 19 of the inkjet head 29 is formed.

As illustrated in FIG. 2B, the heights of the head flow inlet 31, the head flow outlet 32, the storage chamber flow outlet 37 (i.e., the storage chamber open-close valve 54), and the liquid storage chamber 35 with respect to the discharge surface are h1, h2, h3, and ha, respectively. The absolute pressures of the ink at the head flow inlet 31, the head flow outlet 32, in the storage chamber open-close valve 54, in the discharge nozzle 19, and in the liquid storage chamber 35 are P1, P2, P3, Ph, and Pa, respectively.

In the flow channel between the head flow inlet 31 and the discharge nozzle 19, no member (for example, a filter) having a relatively large resistance value is provided. Consequently, a differential pressure of the absolute pressure Ph of the ink in the discharge nozzle 19 and the absolute pressure P1 of the ink at the head flow inlet 31 can be approximately expressed by a water head difference. In other words, a differential pressure Ph−P1 of the absolute pressure Ph and the absolute pressure P1 can be expressed as follows:

$$Ph-P1=\rho\cdot g\cdot h1 \qquad \text{expression 1}$$

wherein a density of the ink is ρ, an acceleration of gravity is g.

In the flow channel between the discharge nozzle 19 and the pressure adjustment unit 34, no member having a relatively large resistance value is provided. Consequently, the differential pressure Ph−P2 of the absolute pressure Ph of the ink in the discharge nozzle 19 and the absolute pressure P2 of the ink at the head flow outlet 32, and the differential pressure Ph−Pa of the absolute pressure Ph and the absolute pressure Pa of the ink in the liquid storage chamber 35 can be approximately expressed by water head differences respectively as follows:

$$Ph-P2=\rho\cdot g\cdot h2$$

$$Ph-Pa=\rho\cdot g\cdot ha \qquad \text{expression 2.}$$

Accordingly, in a state where the ink in the head unit 1 is not flowing, the equilibrium state can be represented by the following relationship:

$$\left.\begin{aligned} Ph &= P1+\rho\cdot q\cdot h1 \\ &= P2+\rho\cdot g\cdot h2 \\ &= Pa+\rho\cdot g\cdot ha \end{aligned}\right\}. \qquad \text{expression 3}$$

If the volume of the liquid storage chamber 35 is constant, that is, the flexible member 53 and the spring receiving plate 60 are not moving, the equilibrium state of the forces acting on the flexible member 53 and the spring receiving plate 60 can be represented by the following relationship:

$$P0\cdot Ma=Pa\cdot Ma+Wa \qquad \text{expression 4.}$$

In the expression, P0 is an absolute pressure (for example, atmospheric pressure) of the outside of the inkjet head 29 or the pressure adjustment unit 34, Ma is an area of the flexible member 53 and the spring receiving plate 60 projected in the Y2 direction, and Wa is a load of the second spring 57.

As will be understood from the expression 2, the second spring 57 that is a compressed spring presses the internal surface of the flexible member 53 via the spring receiving plate 60, and thereby the absolute pressure Pa of the ink in the liquid storage chamber 35 becomes lower than the absolute pressure P0 of the outside of the pressure adjustment unit 34. The load Wa of the second spring 57 varies depending on the amount of compression of the second spring 57, and consequently, the absolute pressure Pa varies depending on the amount of compression of the second spring 57.

In a state where the second arm end portion 62 does not contact the valve element 55, and the valve element 55 blocks the storage chamber flow outlet 37, the following relationship is satisfied:

$$Pa\cdot M3\leq W3+P3\cdot M3 \qquad \text{expression 5.}$$

In the expression, M3 is an opening area of the storage chamber flow outlet 37, and W3 is a magnitude of the load of the first spring 56.

A maximum value Wbamx of a load Wb to be applied by the arm 59 to the valve element 55 is represented as follows using a distance L1 from the first arm end portion 61 to the rotation center 58, and a distance L2 from the second arm end portion 62 to the rotation center 58:

$$Wb\max=Wa\cdot L2/L1 \qquad \text{expression 6.}$$

When the decompression pump 45 is driven from a state where the ink is not flowing, that is, the state where the relationship represented by the expression 1 to the expression 3 is satisfied, the pressure in the second sub-tank 40 decreases. As a result, the ink in the storage chamber open-close valve 54 flows toward the second sub-tank 40, and the absolute pressure P3 of the ink in the storage chamber open-close valve 54 decreases.

To prevent excessive decrease of the pressure of the ink in the second sub-tank 40, it is preferable to drive the decompression pump 45 while the pressure sensor 44 detects the pressure of the air in the second sub-tank 40.

When the absolute pressure P3 of the ink at the storage chamber flow outlet 37 decreases to a predetermined value, the relationship represented by the expression 3 changes to the following relationship:

$$Pa\cdot M3>W3+P3\cdot M3 \qquad \text{expression 7.}$$

The expression 5 represents that the valve element 55 starts to move in the direction to open the storage chamber flow outlet 37. When the storage chamber flow outlet 37 is opened, the ink in the liquid storage chamber 35 starts to flow toward the second sub-tank 40.

As a result, the absolute pressure Pa of the ink in the liquid storage chamber 35 decreases, and the ink in the first sub-tank 5 is fed through the head flow inlet 31 and the head flow outlet 32 to the liquid storage chamber 35. In other words, in the state where the ink is flowing by the drive of the decompression pump 45, the relationship represented by the expression 1 changes to the following relationship:

$$P1+\rho\cdot g\cdot h1>P2+\rho\cdot g\cdot h2>Pa+\rho\cdot g\cdot ha \quad \text{expression 8.}$$

The absolute pressure P3 of the ink at the storage chamber flow outlet 37 is reduced by the decompression pump 45, and consequently, "P3+ρ·g·ha" is smaller than "Pa+ρ·g·ha".

Further, due to the decrease of the absolute pressure Pa of the ink in the liquid storage chamber 35, the relationship represented by the expression 2 changes to the following relationship:

$$P0\cdot Ma>Pa\cdot Ma+Wa \quad \text{expression 9.}$$

The expression 6 represents that the valve element 53 and the spring receiving plate 60 start to move in the Y2 direction. In other words, due to the difference in pressure between the inside and the outside of the pressure adjustment unit 34, the flexible member 53 and the spring receiving plate 60 move in the Y2 direction, and the arm 59 rotates in the direction in which the second arm end portion 62 is separated from the valve element 55.

Due to the outflow of the ink in the liquid storage chamber 35, when the absolute pressure Pa of the ink in the liquid storage chamber 35 decreases, the relationship represented by the expression 5 returns to the relationship represented by the expression 3. In other words, the valve element 55 closes the storage chamber flow outlet 37 with the force of the first spring 56. As a result, the pressure adjustment unit 34 becomes in the state (the time T1 in FIG. 4) illustrated in FIG. 3A. In this state, the absolute pressure Pa of the ink in the liquid storage chamber 35 is defined as Pa1.

When the storage chamber flow outlet 37 is closed, the ink flowed from the inkjet head 29 into the liquid storage chamber 35 remains in the liquid storage chamber 35. As a result, the absolute pressure Pa in the liquid storage chamber 35 increases (the time period T2 in FIG. 4), and the flexible member 53 and the spring receiving plate 60 move in the Y1 direction.

Due to the movement of the spring receiving plate 60 in the Y1 direction, the arm 59 rotates in the X direction, and the second arm end portion 62 contacts the valve element 55 (FIG. 3B). In this state, the absolute pressure Pa of the ink in the liquid storage chamber 35 is defined as Pa2.

When the spring receiving plate 60 further moves in the Y1 direction, the arm 59 moves the valve element 55 in the direction to open the storage chamber flow outlet 37 (the state illustrated in FIG. 3C, and the time period T3 in FIG. 4).

The absolute pressure Pa2 of the ink in the liquid storage chamber 35 is higher than the absolute pressure P3 of the ink in the storage chamber open-close valve 54. Consequently, the release of the storage chamber flow outlet 37 allows the ink in the liquid storage chamber 35 to flow out through the storage chamber flow outlet 37 toward the second sub-tank 40.

The outflow of the ink in the liquid storage chamber 35 through the storage chamber flow outlet 37 reduces the absolute pressure Pa in the liquid storage chamber 35, and moves the spring receiving plate 60 in the Y2 direction. As a result, the arm 59 rotates in the opposite direction of the X1 direction, and separates from the valve element 55, and the valve element 55 blocks the storage chamber flow outlet 37 (the time T1 in FIGS. 3A and FIG. 4).

As described above, the pressure adjustment unit 34 repeats the states illustrated in FIGS. 3A and 3C through the state in FIG. 3B according to the difference in pressure between inside and outside of the pressure adjustment unit 34. Such operation of the pressure adjustment unit 34 adjusts the absolute pressure Pa of the ink in the liquid storage chamber 35 within the range from Pa1 to Pa2, and the ink in the first sub-tank 5 is fed to the second sub-tank 40 via the inkjet head 29.

The liquid storage chamber 35 always communicates with the inkjet head 29. Consequently, the pressure adjustment unit 34 opens or closes the storage chamber flow outlet 37 according to the difference in pressure between inside and outside of the inkjet head 29 to adjust the pressure in the inkjet head 29.

The pressure adjustment unit 34 does not necessarily require repetitive open/close operation by the valve element 55 in the storage chamber flow outlet 37. For example, the second arm end portion 62 may slightly open the storage chamber flow outlet 37 to allow the ink to continuously flow.

The inkjet apparatus according to the present exemplary embodiment reduces the pressure in the inkjet head 29 using the liquid feeding unit including the second sub-tank 40 and the decompression pump 45. Consequently, even if the pressure adjustment unit 34 is disposed on a upper side of the inkjet head 29 in the direction of gravitational force, the inside of the inkjet head 29 can be controlled at a negative pressure. In other words, the installation location of the pressure adjustment unit is not limited.

Further, the pressure adjustment unit 34 for adjusting the pressure in the inkjet head 29 is provided in the middle of the ink flow channel from the inkjet head 29 to the second sub-tank 40. Consequently, even if the pressure in the second sub-tank 40 is reduced to a relatively low pressure by the decompression pump 45, the pressure in the inkjet head 29 is maintained at a predetermined slightly negative pressure.

The pressure adjustment unit 34 is mounted on the carriage 10 together with the inkjet head 29.

In the serial-type inkjet apparatus, if the pressure adjustment unit is fixed on the body of the inkjet apparatus not on the carriage, and the pressure adjustment unit and the inkjet head are connected using a liquid conducting tube formed of a flexible material, the pressure in the inkjet head may vary. This is because the liquid conducting tube deforms due to the carriage reciprocating motion, and due to the deformation of the liquid conducting tube, the pressure in the inkjet head may vary.

In the present exemplary embodiment, the pressure adjustment unit 34 is mounted on the carriage 10 together with the inkjet head 29, and consequently, the position of the inkjet head 29 with respect to the pressure adjustment unit 34 is not changed. Consequently, the deformation in the flow channel between the inkjet head 29 and the pressure adjustment unit 34 can be prevented, and the variation of the pressure of the ink in the inkjet head 29 can be reduced.

The inkjet apparatus according to the present exemplary embodiment includes the first filter 33 in the middle of the first sub-tank 5 and the inkjet head 29. The first filter 33 prevents dust particles contained in the ink in the first sub-tank 5 from reaching the inkjet head 29, and thereby clogging of the discharge nozzle due to the dust particles can be prevented.

The second filter 38 is disposed in the middle of the liquid flow channel from the pressure adjustment unit 34 to the second sub-tank 40.

In the pressure adjustment unit 34 illustrated in FIG. 2, fine dusts (particle) may be generated when the valve element 55 moves in the open/close operation of the storage chamber flow outlet 37. If such dusts flow into the inkjet head 29, the discharge nozzle 19 may be clogged with the dust.

In the inkjet apparatus according to the present exemplary embodiment, the pressure adjustment unit 34 and the second filter 38 are disposed on the downstream side of the inkjet head 29 in the ink flow direction. Consequently, the fine dusts generated in the pressure adjustment unit 34 are prevented from flowing into the inkjet head 29, and the clogging of the discharge nozzle 19 can be reduced.

In the inkjet apparatus having the second filter 38 between the inkjet head 29 and the liquid feeding unit, if the ink feeding power of the liquid feeding unit is not enough, sometimes, bubbles in the ink or bubbles flowing from the discharge nozzle cannot pass through the second filter 38. For example, it can occur when the dusts adhere to the second filter 38, and the resistance to flow at the second filter 38 increases.

In such a case, the bubbles do not pass through the second filter 38, and sometimes gas is collected in the second filter 38. If the ink feeding power of the liquid feeding unit is increased so that the bubbles can pass through the second filter 38, the pressure in the inkjet head 29 is reduced too much.

In the inkjet apparatus according to the present exemplary embodiment, the second filter 38 is disposed on the downstream side of the pressure adjustment unit 34 in the ink flow direction. Consequently, the increase of the ink feeding power by the liquid feeding unit enables the bubbles in the ink or the bubbles flowing from the discharge nozzle to pass through the second filter 38, and thereby, the pressure adjustment unit 34 can prevent the decrease in pressure in the inkjet head 29.

The pressure of the ink in the inkjet head 29 is maintained at a predetermined value, and thereby the ink flow amount can be maintained constant. As a result, the variation of the temperature of the ink in the inkjet head 29 can be reduced. Especially, in the inkjet head 29 that discharges the ink using heat, the variation in the ink temperature causes variation in the ink discharge amount, and as a result, the quality of the recorded image may be decreased. By maintaining the ink flow amount constant, the variation in the ink temperature in the inkjet head 29 can be reduced, and the quality of the recorded image can be increased.

Further, in the present exemplary embodiment, the inkjet head 29, the pressure adjustment unit 34, and the first and second filters 33 and 38 constitute one head unit 1, and the head unit 1 is detachably mounted on the inkjet apparatus. The first and second filters 33 and 38 can prevent dusts in the air from flowing into the inkjet head 29 and the pressure adjustment unit 34 in the state where the head unit 1 is not mounted on the inkjet apparatus.

Further, the head unit 1 is formed as one unit, and consequently, the inkjet head 29 and the pressure adjustment unit 34 are not to be individually replaced. As a result, the inkjet head 29 and the pressure adjustment unit 34 can be replaced more easily.

A specific structure of the inkjet apparatus according to the present exemplary embodiment is described.

For example, in the inkjet head 29, it is confirmed that when the absolute pressure Ph of the ink in the discharge nozzle 19 is maintained at a pressure lower than the absolute pressure P0 of the outside of the inkjet head 29 by about 0.6 kPa, a good ink meniscus is formed.

When the height h2 of the head flow outlet 32 with respect to the discharge nozzle 19 is 2 cm, the absolute pressure P2 of the ink at the head flow outlet 32 is represented as follows by defining the product of the density ρ of the ink and the acceleration of gravity g to be 10 kPa/m:

$$\begin{aligned} P2 &= Ph - 0.02 \cdot \rho \cdot g \\ &= P0 - 0.6 - 0.2 \\ &= P0 - 0.8 \quad [kPa]. \end{aligned} \qquad \text{expression 10}$$

When the height ha of the liquid storage chamber 35 with respect to the discharge nozzle 19 is 4 cm, and the height h3 of the storage chamber flow outlet 37 with respect to the discharge nozzle 19 is 6 cm, the absolute pressure Pa of the ink in the liquid storage chamber 35 is represented as follows:

$$\begin{aligned} Pa &= Ph - 0.04 \cdot \rho \cdot g \\ &= P0 - 0.6 - 0.4 \\ &= P0 - 1 \quad [kPa]. \end{aligned} \qquad \text{expression 11}$$

When the height 11 of the discharge nozzle 19 with respect to the ink liquid level of the first sub-tank 5 is 1 cm, and the height h1 of the head flow inlet 31 with respect to the discharge nozzle 19 is 1 cm, the absolute pressure P1 of the ink at the head flow inlet 31 is represented as follows:

$$\begin{aligned} P1 &= P0 - \rho \cdot g \cdot (0.01 + 0.01) \\ &= P0 - (0.1 + 0.1) \\ &= P0 - 0.2 \quad [kPa]. \end{aligned} \qquad \text{expression 12}$$

When the area Ma of the flexible member 53 and the spring receiving plate 60 is 10 $cm^2$, to satisfy the expression 7 with the absolute pressure Pa of the ink in the liquid storage chamber 35, the load Wa of the second spring 57 is designed as follows from the expression 2:

$$\begin{aligned} Wa &= (P0 - Pa) \cdot Ma \\ &= \{P0 - (P0 - 1)\} \cdot Ma \\ &= 100 \quad [gf]. \end{aligned} \qquad \text{expression 13}$$

When the distances L1 and L2 of the arm 59 are 2 cm and 1 cm respectively, the maximum load Wbmax to be applied to the valve element 55 by the arm 59 is calculated according to the expression 4 as follows:

$$Wb\text{max}=50 \text{ [gf]} \qquad \text{expression 14.}$$

When the maximum load Wbmax is applied to the valve element 55, the load W3 of the first spring 56 of the storage chamber open-close valve 54 is set to 40 gf so that the valve element 55 moves in the direction to open the storage chamber flow outlet 37.

When the opening area M3 of the storage chamber flow outlet 37 is 4 $\pi mm^2$, to close the storage chamber flow outlet 37 in a state where the arm 59 does not contact the valve element 55, the absolute pressure P3 in the storage chamber open-close valve 54 is to be set to satisfy the following relationship according to the expression 5:

$$P3 \geqq Pa - W3/M3 \qquad \text{expression 15}$$
$$\geqq P0 - 31.8 \quad [kPa].$$

In other words, when the decompression pump 45 is driven and the absolute pressure P3 in the storage chamber open-close valve 54 is reduced to P0−31.8 kPa or less, the storage chamber flow outlet 37 is always opened. Consequently, the decompression pump is driven so that the absolute pressure P3 is to be P0−10 kPa.

When the inkjet apparatus having the above-described structure was driven, the pressure of the ink in the inkjet head 29 stabilized at about P0−0.6 kPa. Around the second filter 38, no gas collected. This was because the pressure (that is, the absolute pressure P3 of the ink in the storage chamber open-close valve 54) around the second filter 38 is reduced to P0−10 kPa.

Hereinafter, a pressure adjustment unit having a structure different from that of the pressure adjustment unit 34 illustrated in FIGS. 2A, 2B, 3A, 3B, and 3C is described with reference to FIG. 5 and FIGS. 6A and 6B. The components similar to those in the pressure adjustment unit 34 illustrated in FIGS. 2A, 2B, 3A, 3B, and 3C are briefly described using the same reference numerals.

Figure 5:
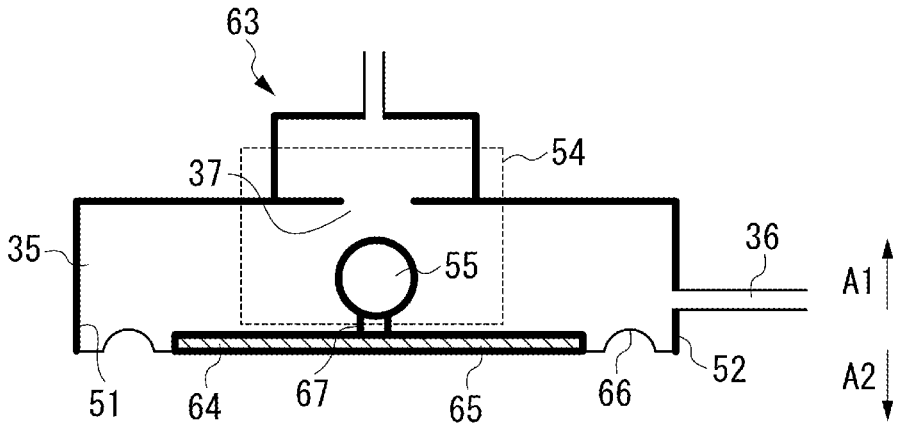
FIG. 5 is a cross-sectional view illustrating another pressure adjustment unit.

FIG. 5 is a cross-sectional view illustrating a pressure adjustment unit 63 having a structure different from that of the pressure adjustment unit 34 illustrated in FIGS. 2A, 2B, 3A, 3B, and 3C. FIG. 6 is a view illustrating operation of the pressure adjustment unit 63 illustrated in FIG. 5.

As illustrated in FIG. 5, the pressure adjustment unit 63 includes the storage chamber member 52 having the recessed portion 51 and a metal diaphragm 64. The metal diaphragm 64 covers the opening of the recessed portion 51, and is formed of a thin-walled stainless material. The liquid storage chamber 35 in the pressure adjustment unit 63 includes the recessed portion 51 and the metal diaphragm 64.

The metal diaphragm 64 includes a thick portion 65 having a relatively large thickness, and formed in the central part of the metal diaphragm 64, and a thin portion 66 having a thickness thinner than the thick portion 65, and formed at a periphery of the metal diaphragm 64.

When the circulation operation of the ink is started by the inkjet apparatus, the metal diaphragm 64 deforms in the thickness direction (the A1 direction in FIG. 5). Due to an elastic force We that is the force to return to the original shape, the pressure of the ink in the liquid storage chamber 35 is adjusted to a slightly negative pressure state.

The valve element 55 is fixed to the metal diaphragm 64 via an axis 67. In response to the deformation of the metal diaphragm 64 in the A1 and A2 directions, the valve element 55 moves, and the storage chamber flow outlet 37 is opened and closed.

Figure 6A:
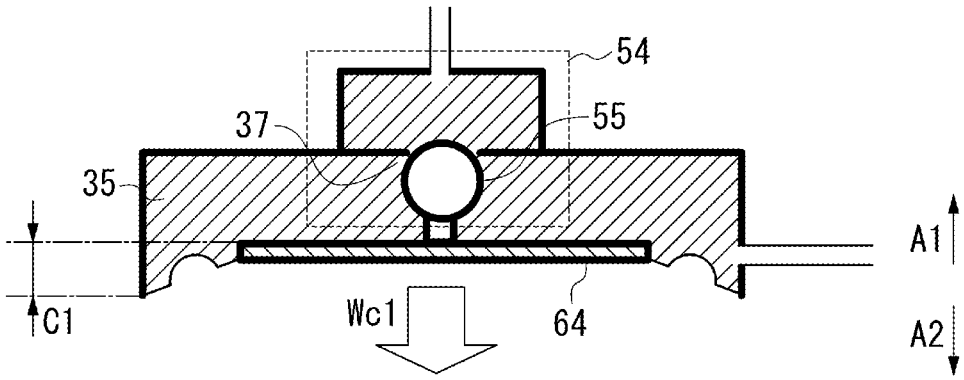
FIGS. 6A and 6B illustrate operation of the pressure adjustment unit illustrated in FIG. 5.

FIG. 6A illustrates the state where the storage chamber flow outlet 37 is closed. FIG. 6B illustrates the state where the storage chamber flow outlet 37 is opened.

The drive of the decompression pump 45 allows the ink in the liquid storage chamber 35 to flow out through the storage chamber flow outlet 37. Due to the outflow, the absolute pressure P3 of the ink in the liquid storage chamber 35 decreases, and the metal diaphragm 64 moves in the A1 direction. As a result, the storage chamber flow outlet 37 is closed.

In the state where the storage chamber flow outlet 37 is closed, as illustrated in FIG. 6A, the metal diaphragm 64 deforms at a maximum amount (the amount of deformation of the metal diaphragm 64 in this state is defined as C1) in the A1 direction. In such a state, the absolute pressure Pa of the ink in the liquid storage chamber 35 is reduced to a minimum pressure value (the absolute pressure Pa1 in FIG. 4).

Figure 6B:
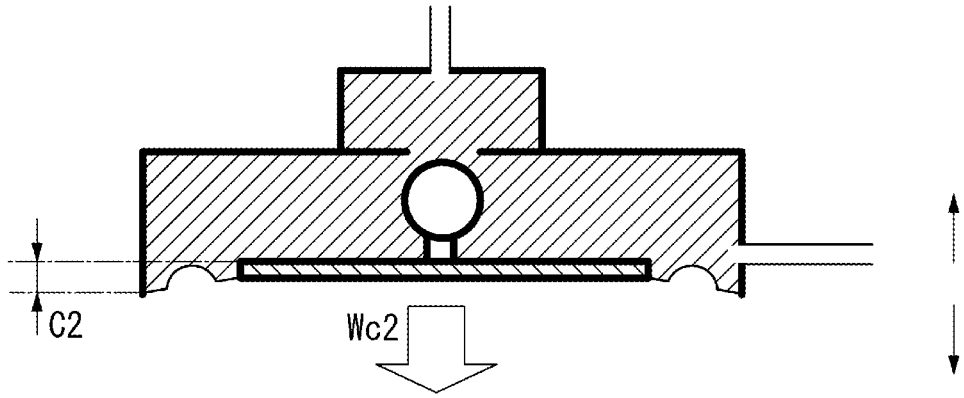

From the state illustrated in FIG. 6A, due to the elastic force Wc, the metal diaphragm 64 moves in the A2 direction, and the storage chamber flow outlet 37 is opened as illustrated in FIG. 6B. The amount of deformation of the metal diaphragm 64 in this state is defined as C2.

In the state illustrated in FIG. 6B, the metal diaphragm 64 deforms by the amount of C2 that is smaller than C1. Consequently, the ink in the liquid storage chamber 35 has the absolute pressure Pa2 (see FIG. 4) that is larger than the absolute pressure Pa1.

In the ink circulation operation, the pressure adjustment unit 63 operates by repeating the states illustrated in FIGS. 6A and 6B.

Using the metal diaphragm 64 as the flexible member 53 (FIGS. 3A, 3B, and 3C), the pressure adjustment unit 63 that does not include the first and second springs 56 and 57 included in the pressure adjustment unit 34 (FIGS. 3A, 3B, and 3C) can be provided.

Figure 7:
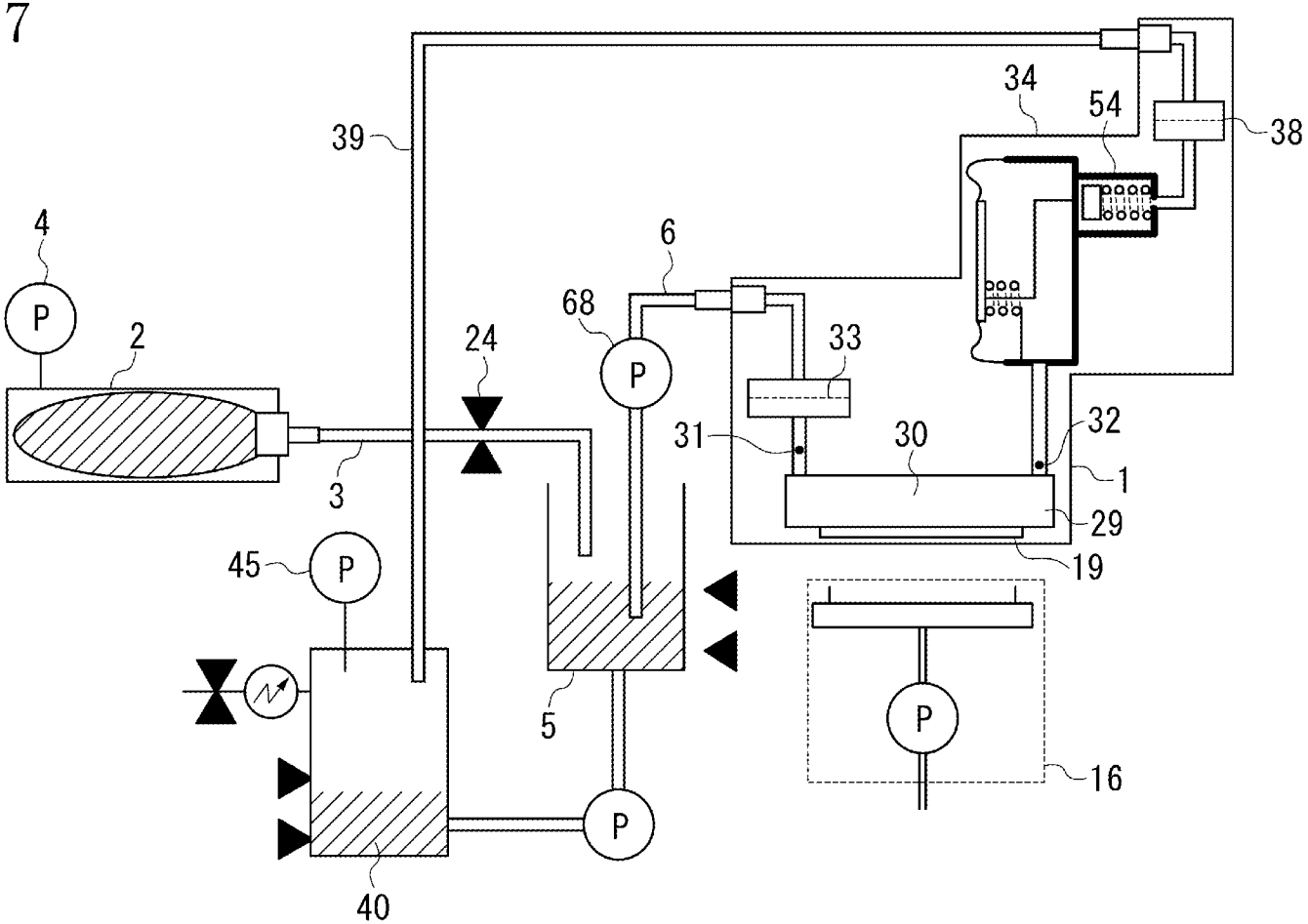
FIG. 7 is a schematic view illustrating a structure of an ink supply system in an inkjet apparatus according to a second exemplary embodiment.

An inkjet apparatus according to a second exemplary embodiment of the present invention is described with reference to FIG. 7. FIG. 7 is a schematic view illustrating a structure of an ink supply system in an inkjet apparatus according to the present exemplary embodiment. To components similar to those in the inkjet apparatus according to the first exemplary embodiment, the same reference numerals are applied, and the components are briefly described.

As illustrated in FIG. 7, the inkjet apparatus according to the present exemplary embodiment includes a liquid feeding pump 68 in the middle of the second liquid conducting tube 6. Preferably, the liquid feeding pump 68 is a pump that can feed the ink of a fixed quantity to the inkjet head 29, for example, a tube pump can be employed.

Also in the present exemplary embodiment, when the ink is circulated, the absolute pressure P1 of the ink at the head flow inlet 31, the absolute pressure P2 of the ink at the head flow outlet 32, and the absolute pressure P3 of the ink at the storage chamber flow outlet 37 satisfy the following relationship:

$$P1+\rho\cdot g\cdot h1>P2+\rho\cdot g\cdot h2>P3+\rho\cdot g\cdot h3 \qquad \text{expression 16.}$$

In the present exemplary embodiment, the liquid feeding pump 68 applies pressure to the ink in the first sub-tank 5 and supplies the ink to the inkjet head 29.

The ink in the inkjet head 29 is fed to the pressure adjustment unit 34 when the absolute pressure P1 of the ink at the head flow inlet 31 and the absolute pressure P2 of the ink at the head flow outlet 32 satisfy the following relationship:

$$P1+\rho\cdot g\cdot h1>P2+\rho\cdot g\cdot h2 \qquad \text{expression 17.}$$

The absolute pressure Ph of the ink in the discharge nozzle 19 is P2+ρ·g·h2, and maintained to the pressure (in the slightly negative pressure state) lower than the atmospheric pressure P0.

The ink in the liquid storage chamber 35 is fed to the second sub-tank 40 when the absolute pressure P2 at the head flow outlet 32 and the absolute pressure P3 of the ink at the storage chamber flow outlet 37 satisfy the following relationship:

$$P2+\rho\cdot g\cdot h2>P3+\rho\cdot g\cdot h3 \qquad \text{expression 18.}$$

The inkjet apparatus according to the present exemplary embodiment reduces the pressure in the inkjet head 29 using the liquid sending unit including the second sub-tank 40 and the decompression pump 45. Consequently, even if the pressure adjustment unit 34 is disposed on an upper side of the inkjet head 29 in the direction of gravitational force, the inside of the inkjet head 29 can be controlled at a negative pressure. In other words, the installation location of the pressure adjustment unit is not limited.

Further, the inkjet apparatus according to the present exemplary embodiment includes the liquid feeding pump on the second liquid conducting tube 6. Consequently, when the resistance to flow in the second liquid conducting tube 6 is increased, for example, when the second liquid conducting tube 6 deforms due to the movement of the carriage, the ink can be surely supplied from the first sub-tank 5 to the inkjet head 29.

A third exemplary embodiment of the present invention is described with reference to FIG. 8 and FIG. 9.

Figure 8:
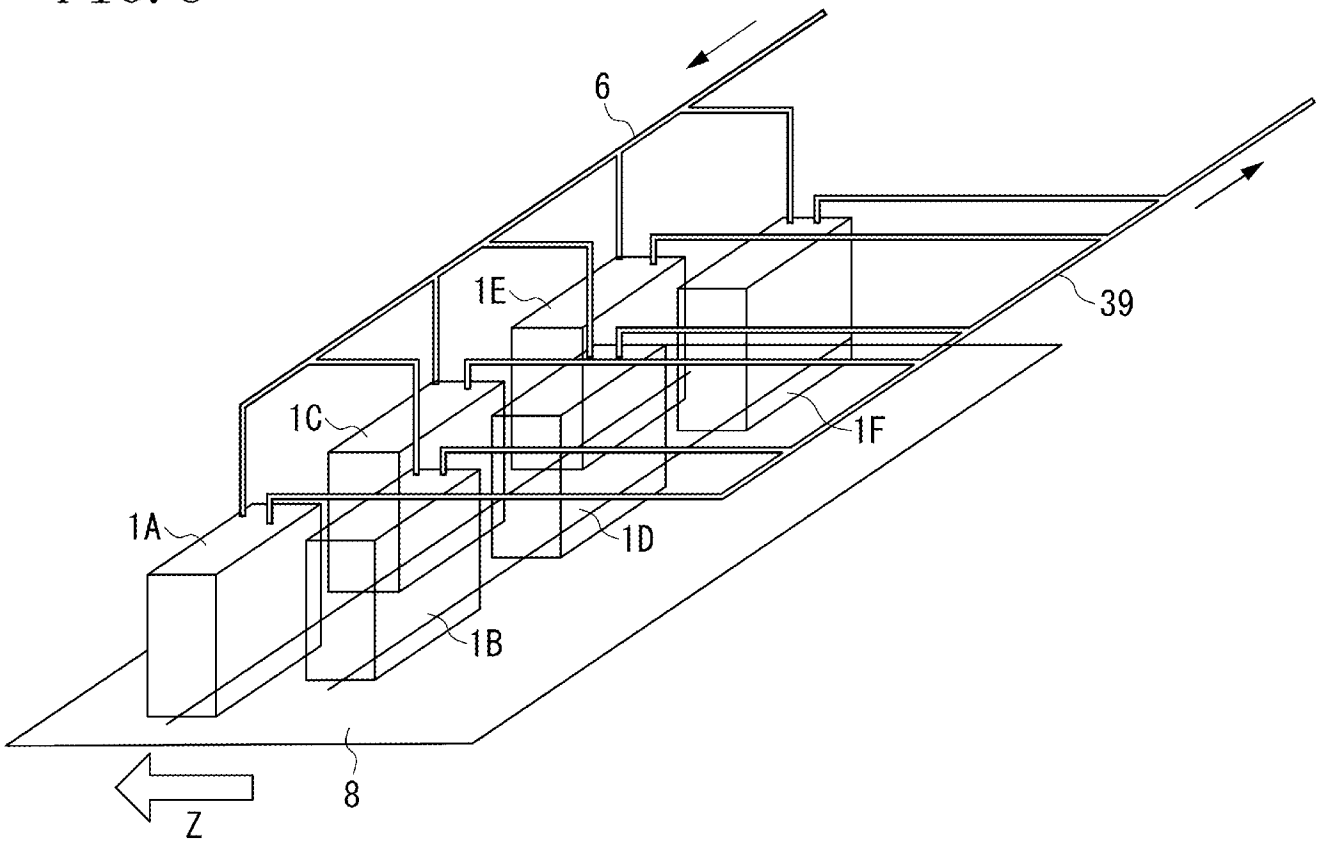
FIG. 8 is a perspective view illustrating an inkjet head unit in an inkjet apparatus according to a third exemplary embodiment.
Figure 9:
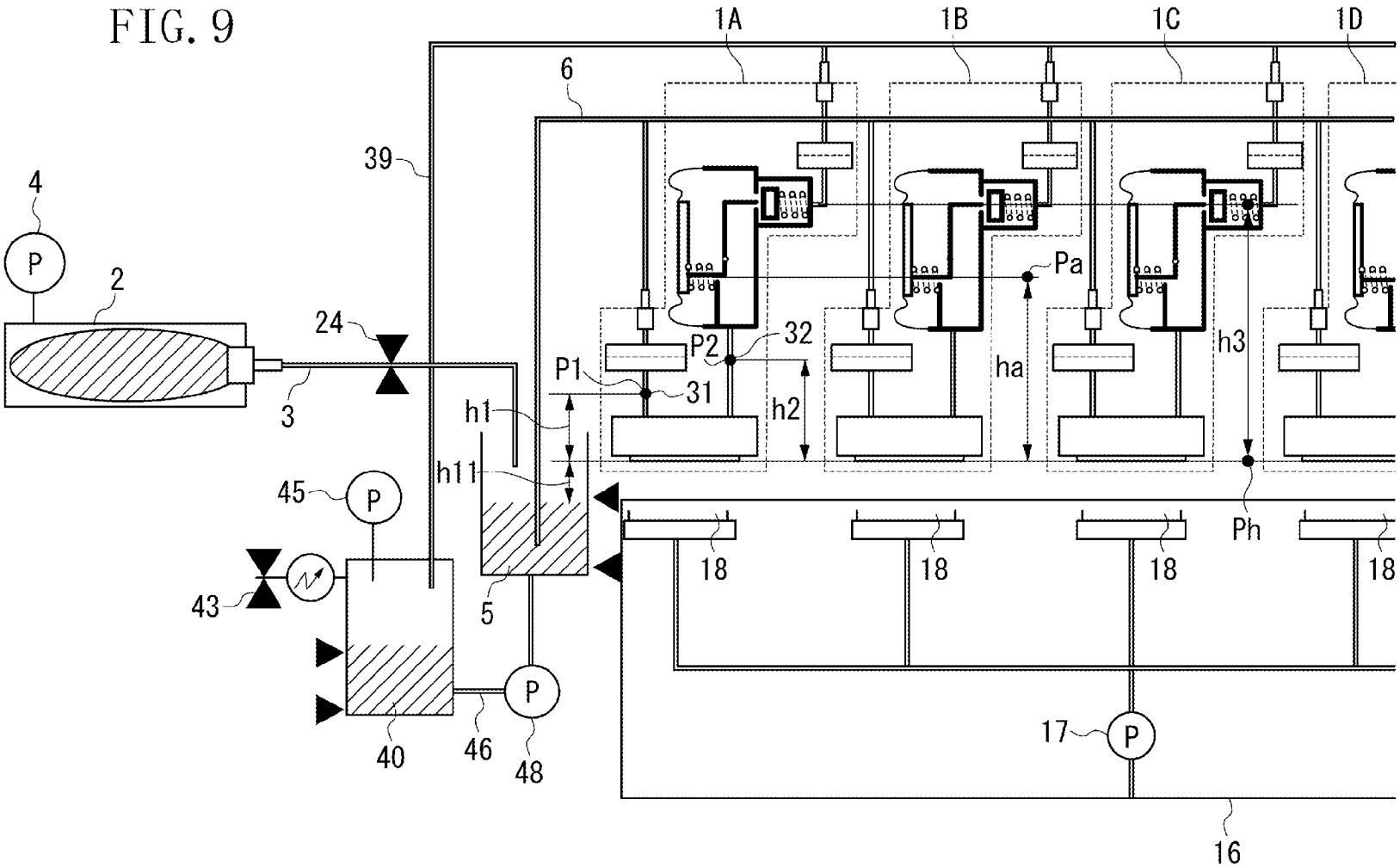
FIG. 9 is a schematic view illustrating an ink supply system in the inkjet apparatus according to the third exemplary embodiment.

FIG. 8 is a perspective view illustrating an inkjet head unit in an inkjet apparatus according to the present exemplary embodiment. FIG. 9 is a perspective view illustrating an inkjet supply system in the inkjet apparatus according to the present exemplary embodiment.

As illustrated in FIG. 8, the inkjet apparatus according to the present exemplary embodiment includes a plurality of head units 1. The individual head units 1A, 1B, 1C, 1D, 1E, and 1F have a structure similar to that of the head unit 1 in the inkjet apparatus according to the first exemplary embodiment, respectively.

The individual head units 1A, 1B, 1C, 1D, 1E, and 1F are disposed in a staggered arrangement along a predetermined direction. The individual nozzle arrays in the head units 1A, 1B, 1C, 1D, 1E, and 1F are arranged in parallel in the predetermined direction.

The width of the nozzle array group of the nozzle arrays of the head units 1A, 1B, 1C, 1D, 1E, and 1F in the predetermined direction is larger than the width of the recording medium 8 in the predetermined direction. In other words, in the inkjet apparatus according to the present exemplary embodiment, recording can be performed on the entire recording medium 8 without reciprocating the head units 1A, 1B, 1C, 1D, 1E, and 1F in the predetermined direction. Such an inkjet apparatus is called a line type inkjet apparatus.

The line type inkjet apparatus discharges ink droplets while moving the recording medium 8 disposed to face the discharge surfaces of the fixed head units 1A, 1B, 1C, 1D, 1E, and 1F in the direction intersecting with the predetermined direction to perform image formation on the recording medium 8.

In the present exemplary embodiment, the second liquid conducting tube 6 connected to the first sub-tank 5 (FIG. 9) is divided into six tubes, and the tubes are connected to the flow inlets of the individual head units 1A, 1B, 1C, 1D, 1E, and 1F respectively. The third liquid conducting tube 39 connected to the second sub-tank 40 (FIG. 9) is also divided into six tubes, and the tubes are connected to the flow outlets of the individual head units 1A, 1B, 1C, 1D, 1E, and 1F respectively.

The individual head units 1A, 1B, 1C, 1D, 1E, and 1F are formed by unitizing the first filter 33, the inkjet head 29, the pressure adjustment unit 34, and the second filter 38, respectively. The recovery device 16 includes six nozzle caps 18A, 18B, 18C, 18D, 18E, and 18F. The nozzle caps are connected in parallel to one recovery pump 17.

The inkjet apparatus according to the present exemplary embodiment reduces the pressure in the inkjet head 29 using the liquid sending unit including the second sub-tank 40 and the decompression pump 45. Consequently, even if the pressure adjustment unit 34 is disposed on an upper side of the inkjet head 29 in the direction of gravitational force, the inside of the inkjet head 29 can be controlled at a negative pressure. In other words, the installation location of the pressure adjustment unit is not limited.

Further, the pressure adjustment unit 34 for adjusting the pressure in the inkjet head 29 is provided on the downstream side with respect to the ink flow from the inkjet head 29 corresponding to each inkjet head 29. Consequently, even if the pressure in the second sub-tank 40 is reduced by the decompression pump 45 to a pressure lower than an expected pressure, the pressure in the individual inkjet heads 29 is maintained at a predetermined slightly negative pressure respectively.

Further, the ink flow amounts flowing in the individual inkjet heads 29 can be substantially equalized. As a result, uneven print density due to the variation in the temperature of the ink among the individual inkjet heads 29 that tends to occur in image formation in the line type inkjet apparatus can be reduced.

A plurality of head units may be mounted on the carriage 10 (FIG. 1) and the plurality of head units may reciprocate together with the carriage 10 over the recording medium 8.

While the ideas and concepts of the present disclosure have been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-240298 filed Nov. 1, 2011, which is hereby incorporated by reference herein in its entirety.

What is claimed is:

1. An inkjet head unit comprising:

an inkjet head; and an operation mechanism disposed downstream of the inkjet head in an ink flow direction, wherein the inkjet head unit is arranged between an ink retaining unit and a negative pressure source in an inkjet recording apparatus having the ink retaining unit configured to retain the ink supplied to the inkjet head and the negative pressure source configured to apply negative pressure to the inkjet head to supply the ink from the ink retaining unit to the inkjet head, wherein the operation of the operation mechanism maintains the negative pressure state of the inkjet head and adjusts the flow of the ink while the ink discharge operation from the inkjet head is being performed, wherein the operation mechanism is disposed on an ink flow channel in which the ink flows, and includes a flexible member and an open-close mechanism, wherein the flexible member is urged from inside of the flow channel to outside of the flow channel, and wherein the open-close mechanism moves due to a deformation of the flexible member caused by a difference between the pressure in the ink flow channel communicating with an inkjet head side and the pressure in the ink flow channel communicating with the negative pressure source, and opens or closes the ink flow channel.

2. The inkjet head unit according to claim 1, further comprising a first ink flow channel connected to the ink retaining unit, and a second ink flow channel connected to the negative pressure source, each of the first and second ink flow channels including a filter.

3. The inkjet head unit according to claim 1, wherein the inkjet head in the inkjet head unit includes a flow inlet connected to the ink retaining unit and a flow outlet connected to the operation mechanism, and the inkjet head satisfies the relationship of $P1+\rho\cdot g\cdot h1>P2+\rho\cdot g\cdot h2>P3+\rho\cdot g\cdot h3$, wherein a pressure of the ink at the flow inlet is P1, a pressure of the ink at the flow outlet is P2, a pressure of the ink of the downstream side of the operation mechanism is P3, a height of the flow inlet with respect to the discharge nozzle of the inkjet head is h1, a height of the flow outlet with respect to the discharge nozzle is h2, a height of the operation mechanism with respect to the discharge nozzle is h3, a density of the ink is ρ, and an acceleration due to gravity is g, and wherein the operation mechanism performs an open-close operation with a boundary of a predetermined pressure difference between the pressure in the ink flow channel communicating with the inkjet head and the operation mechanism, and the pressure in the ink flow channel communicating with the operation mechanism and the negative pressure source.

4. An inkjet head unit comprising:

an inkjet head configured to discharge ink droplets, which can be attached to, and detached from, an inkjet apparatus having an ink tank configured to retain liquid supplied to the inkjet head, and a liquid feeding unit configured to communicate with the inkjet head and feed the liquid in the ink tank to the inkjet head by reducing the pressure in the inkjet head;

an open-close valve configured to open or close a flow channel connecting the inkjet head and the liquid feeding unit; and a pressure adjustment unit configured to open or close the open-close valve according to a pressure difference between inside and outside of the flow channel to adjust the pressure in the inkjet head, wherein the pressure adjustment unit further includes a flexible member that is a part of a peripheral wall of the flow channel, and is urged from the inside of the flow channel to the outside of the flow channel, and wherein the open-close valve moves due to a deformation of the flexible member caused by a difference in pressure between inside and outside of the ink flow channel and opens or closes the ink flow channel.

5. The inkjet head unit according to claim 4, further comprising a flow-in channel of the liquid connected to the ink tank, and a flow-out channel connected to the liquid feeding unit, and the flow-in channel and the flow-out channel having a filter respectively.

6. The inkjet head unit according to claim 4, wherein the inkjet head in the inkjet head unit includes a flow inlet connected to the ink tank and a flow outlet connected to the pressure adjustment unit, and the inkjet head satisfies the relationship of $P1+\rho\cdot g\cdot h1>P2+\rho\cdot g\cdot h2>P3+\rho\cdot g\cdot h3$ wherein an absolute pressure of the ink at the flow inlet is P1, an absolute pressure of the ink at the flow outlet is P2, an absolute pressure of the ink of downstream side of the open-close valve is P3, a height of the flow inlet with respect to the discharge nozzle of the inkjet head is h1, a height of the flow outlet with respect to the discharge nozzle is h2, a height of the open-close valve with respect to the discharge nozzle is h3, wherein the values of h1, h2, and h3 are positive on the upper side and negative on the lower side in the direction of gravitational force with respect to the discharge nozzle, a density of the ink is ρ, and an acceleration due to gravity is g, and wherein the open-close valve is configured to close if the difference in pressure between inside and outside of the pressure adjustment unit is greater than a predetermined value.

7. An inkjet recording apparatus comprising:

an ink tank;

an inkjet head; and a negative pressure source, wherein the ink tank, the inkjet head, and the negative pressure source are connected by ink flow channels in this order, and a pressure of the inkjet head is adjusted by a layout of the ink tank and the inkjet head in a height direction and negative pressure generated by the negative pressure source, an operation mechanism provided on the ink flow channel between the inkjet head and the negative pressure source, and configured to operate according to a difference between a pressure in the flow channel on the inkjet head side and a pressure in the ink flow channel on the negative pressure source side, wherein while the ink discharge operation from the inkjet head is being performed, the flow of ink from the ink tank through the inkjet head to the negative pressure source is adjusted so the pressure of the inkjet head is maintained in a state suitable for the ink discharge through cooperation between the operation mechanism and the negative pressure source, wherein the operation mechanism includes a flexible member that is a part of the flow channel, and urged from inside of the flow channel to outside of the flow channel, and an open-close mechanism configured to move due to a deformation of the flexible member caused by a difference between the pressure in the ink flow channel communicating the inkjet head and the operation mechanism, and the pressure in the ink flow channel communicating the operation mechanism and the negative pressure source, to open or close the flow channel.

8. The inkjet recording apparatus according to claim 7, further comprising:

a carriage configured to reciprocate in a width direction of a recording medium on an upper side of a conveyance path of the recording medium in the direction of gravitational force, wherein the inkjet head and the operation mechanism are mounted on the carriage.

9. The inkjet recording apparatus according to claim 7, wherein a first filter is provided in a middle of the flow channel connecting the ink tank and the inkjet head, and a second filter is provided in a middle of the flow channel from the operation mechanism to the negative pressure source.

10. The inkjet recording apparatus according to claim 7, wherein a liquid feeding pump is provided in a middle of the flow channel connecting the ink tank and the inkjet head.

11. The inkjet recording apparatus according to claim 7, wherein the inkjet recording apparatus includes a plurality of pairs of the inkjet head and the operation mechanism.

12. The inkjet recording apparatus according to claim 7, wherein the inkjet head includes a flow inlet connected to the ink flow channel connected to the ink tank, and a flow outlet connected to the ink flow channel connected to the operation mechanism, and the inkjet apparatus satisfies the relationship of $P1+\rho\cdot g\cdot h1>P2+\rho\cdot g\cdot h2>P3+\rho\cdot g\cdot h3$ wherein a pressure of the ink at the flow inlet is P1, a pressure of the ink at the flow outlet is P2, a pressure of the ink of downstream side of the operation mechanism with respect to the ink flow direction is P3, a height of the flow inlet with respect to a discharge nozzle provided in the inkjet head is h1, a height of the flow outlet with respect to the discharge nozzle is h2, the height of the operation mechanism with respect to the discharge nozzle is h3, a density of the ink is ρ, and an acceleration due to gravity is g, and wherein the operation mechanism performs an open-close operation according to a difference between the pressure at the ink flow channel communicating with the inkjet head side and the pressure at the ink flow channel communicating with the negative pressure source.

13. An inkjet apparatus comprising:

an inkjet head configured to discharge ink droplets;

an ink tank configured to retain liquid to be supplied to the inkjet head;

a liquid feeding unit communicating with the inkjet head, and configured to feed the liquid in the ink tank to the inkjet head by reducing pressure in the inkjet head; and a pressure adjustment unit having an open-close valve configured to open or close a flow channel connecting the inkjet head and the liquid feeding unit, and configured to open or close the open-close valve according to a pressure difference in the upstream and downstream of the open-close valve to adjust the pressure in the inkjet head, wherein the pressure adjustment unit further includes a flexible member that is a part of a peripheral wall of the flow channel, and urged from inside of the flow channel to outside of the flow channel, and wherein the open-close valve moves due to a deformation of the flexible member caused by a difference in a pressure between upstream and downstream of the open-close valve, and configured to open or close the flow channel.

14. The inkjet apparatus according to claim 13, further comprising a plurality of the inkjet heads, and a plurality of the pressure adjustment units connected to the individual inkjet heads corresponding to the inkjet heads.

15. The inkjet apparatus according to claim 13, wherein the inkjet head includes a flow inlet connected to the ink tank, and a flow outlet connected to the pressure adjustment unit, and the inkjet head satisfies the relationship of $P1+\rho\cdot g\cdot h1>P2+\rho\cdot g\cdot h2>P3+\rho\cdot g\cdot h3$ when an absolute pressure of the ink at the flow inlet is P1, an absolute pressure of the ink at the flow outlet is P2, an absolute pressure of the ink of downstream side of the open-close valve is P3, a height of the flow inlet with respect to the discharge nozzle of the inkjet head is h1, a height of the flow outlet with respect to the discharge nozzle is h2, a height of the open-close valve with respect to the discharge nozzle is h3, wherein the values of h1, h2, and h3 are positive at the upper side and negative at the lower side in the direction of gravitational force with respect to the discharge nozzle, a density of the liquid is ρ, and an acceleration due to gravity is g, and wherein the open-close valve is configured to close if the difference in pressure inside and outside of the pressure adjustment unit is greater than a predetermined value.

16. An inkjet head unit comprising:

an inkjet head; and an operation mechanism disposed downstream of the inkjet head in an ink flow direction, wherein the inkjet head unit is arranged between an ink retaining unit and a negative pressure source in an inkjet recording apparatus having the ink retaining unit configured to retain the ink supplied to the inkjet head and the negative pressure source configured to apply negative pressure to the inkjet head to supply the ink from the ink retaining unit to the inkjet head, wherein the operation of the operation mechanism maintains the negative pressure state of the inkjet head and adjusts the flow of the ink while the ink discharge operation from the inkjet head is being performed, wherein the operation mechanism is disposed on an ink flow channel in which the ink flows, and includes a flexible member and an open-close mechanism, wherein the flexible member is urged from inside the of the flow channel to outside of the flow channel, wherein the open-close mechanism moves due to a deformation of the flexible member caused by a difference between the pressure in the ink flow channel communicating with an inkjet head side and the pressure in the ink flow channel communicating with the negative pressure source, and opens or closes the ink flow channel, wherein the inkjet head in the inkjet head unit includes a flow inlet connected to the ink retaining unit and a flow outlet connected to the operation mechanism, and the inkjet head satisfies the relationship of $P1+\rho\cdot g\cdot h1>P2+\rho\cdot g\cdot h2>P3+\rho\cdot g\cdot h3$, wherein a pressure of the ink at the flow inlet is P1, a pressure of the ink at the flow outlet is P2, a pressure of the ink of the downstream side of the operation mechanism is P3, a height of the flow inlet with respect to the discharge nozzle of the inkjet head is h1, a height of the flow outlet with respect to the discharge nozzle is h2, a height of the operation mechanism with respect to the discharge nozzle is h3, a density of the ink is ρ, and an acceleration due to gravity is g, and wherein the operation mechanism performs an open-close operation with a boundary of a predetermined pressure difference between the pressure in the ink flow channel communicating with the inkjet head and the operation mechanism, and the pressure in the ink flow channel communicating with the operation mechanism and the negative pressure source.

17. An inkjet head unit comprising:

an inkjet head configured to discharge ink droplets, which can be attached to, and detached from, an inkjet apparatus having an ink tank configured to retain liquid supplied to the inkjet head, and a liquid feeding unit configured to communicate with the inkjet head and feed the liquid in the ink tank to the inkjet head by reducing the pressure in the inkjet head;

an open-close valve configured to open or close a flow channel connecting the inkjet head and the liquid feeding unit; and a pressure adjustment unit configured to open or close the open-close valve according to a pressure difference between inside and outside of the flow channel to adjust the pressure in the inkjet head, wherein the pressure adjustment unit further includes a flexible member that is a part of a peripheral wall of the flow channel, and is urged from the inside of the flow channel to the outside of the flow channel, wherein the open-close valve moves due to a deformation of the flexible member caused by a difference in pressure between inside and outside of the ink flow channel and opens or closes the ink flow channel, wherein the inkjet head in the inkjet head unit includes a flow inlet connected to the ink tank and a flow outlet connected to the pressure adjustment unit, and the inkjet head satisfies the relationship of $P1+\rho\cdot g\cdot h1>P2+\rho\cdot g\cdot h2>P3+\rho\cdot g\cdot h3$ wherein an absolute pressure of the ink at the flow inlet is P1, an absolute pressure of the ink at the flow outlet is P2, an absolute pressure of the ink of downstream side of the open-close valve is P3, a height of the flow inlet with respect to the discharge nozzle of the inkjet head is h1, a height of the flow outlet with respect to the discharge nozzle is h2, a height of the open-close valve with respect to the discharge nozzle is h3, wherein the values of h1, h2, and h3 are positive on the upper side and negative on the lower side in the direction of gravitational force with respect to the discharge nozzle, a density of the ink is ρ, and an acceleration due to gravity is g, and wherein the open-close valve is configured to close if the difference in pressure between inside and outside of the pressure adjustment unit is greater than a predetermined value.

18. An inkjet recording apparatus comprising:

an ink tank;

an inkjet head; and a negative pressure source, wherein the ink tank, the inkjet head, and the negative pressure source are connected by ink flow channels in this order, and a pressure of the inkjet head is adjusted by a layout of the ink tank and the inkjet head in a height direction and negative pressure generated by the negative pressure source, an operation mechanism provided on the ink flow channel between the inkjet head and the negative pressure source, and configured to operate according to a difference between a pressure in the flow channel on the inkjet head side and a pressure in the ink flow channel on the negative pressure source side, wherein while the ink discharge operation from the inkjet head is being performed, the flow of ink from the ink tank through the inkjet head to the negative pressure source is adjusted so the pressure of the inkjet head is maintained in a state suitable for the ink discharge through cooperation between the operation mechanism and the negative pressure source, wherein the inkjet head includes a flow inlet connected to the ink flow channel connected to the ink tank, and a flow outlet connected to the ink flow channel connected to the operation mechanism, and the inkjet apparatus satisfies the relationship of $P1+\rho\cdot g\cdot h1>P2+\rho\cdot g\cdot h2>P3+\rho\cdot g\cdot h3$ wherein a pressure of the ink at the flow inlet is P1, a pressure of the ink at the flow outlet is P2, a pressure of the ink of downstream side of the operation mechanism with respect to the ink flow direction is P3, a height of the flow inlet with respect to a discharge nozzle provided in the inkjet head is h1, a height of the flow outlet with respect to the discharge nozzle is h2, the height of the operation mechanism with respect to the discharge nozzle is h3, a density of the ink is ρ, and an acceleration due to gravity is g, and wherein the operation mechanism performs an open-close operation according to a difference between the pressure at the ink flow channel communicating with the inkjet head side and the pressure at the ink flow channel communicating with the negative pressure source.

19. An inkjet apparatus comprising:

an inkjet head configured to discharge ink droplets;

an ink tank configured to retain liquid to be supplied to the inkjet head;

a liquid feeding unit communicating with the inkjet head, and configured to feed the liquid in the ink tank to the inkjet head by reducing pressure in the inkjet head; and a pressure adjustment unit having an open-close valve configured to open or close a flow channel connecting the inkjet head and the liquid feeding unit, and configured to open or close the open-close valve according to a pressure difference in the upstream and downstream of the open-close valve to adjust the pressure in the inkjet head, wherein the inkjet head includes a flow inlet connected to the ink tank, and a flow outlet connected to the pressure adjustment unit, and the inkjet head satisfies the relationship of $P1+\rho\cdot g\cdot h1>P2+\rho\cdot g\cdot h2>P3+\rho\cdot g\cdot h3$ when an absolute pressure of the ink at the flow inlet is P1, an absolute pressure of the ink at the flow outlet is P2, an absolute pressure of the ink of downstream side of the open-close valve is P3, a height of the flow inlet with respect to the discharge nozzle of the inkjet head is h1, a height of the flow outlet with respect to the discharge nozzle is h2, a height of the open-close valve with respect to the discharge nozzle is h3, wherein the values of h1, h2, and h3 are positive at the upper side and negative at the lower side in the direction of gravitational force with respect to the discharge nozzle, a density of the liquid is ρ, and an acceleration due to gravity is g, and wherein the open-close valve is configured to close if the difference in pressure inside and outside of the pressure adjustment unit is greater than a predetermined value.

* * * * *